US008836629B2

(12) United States Patent
Teranishi et al.

(10) Patent No.: US 8,836,629 B2
(45) Date of Patent: Sep. 16, 2014

(54) IMAGE DISPLAY APPARATUS AND IMAGE DISPLAY METHOD

(75) Inventors: Yasuyuki Teranishi, Kanagawa (JP); Yoshiharu Nakajima, Kanagawa (JP); Naoyuki Itakura, Kanagawa (JP); Takayuki Nakanishi, Kanagawa (JP); Yoshitoshi Kida, Kanagawa (JP)

(73) Assignee: Japan Display, Inc., Chita (JP)

( * ) Notice: Subject to any disclaimer, the term of this patent is extended or adjusted under 35 U.S.C. 154(b) by 1260 days.

(21) Appl. No.: 12/075,871

(22) Filed: Mar. 15, 2008

(65) Prior Publication Data

US 2008/0238855 A1 Oct. 2, 2008

(30) Foreign Application Priority Data

Apr. 2, 2007 (JP) ..... P2007-096011

(51) Int. Cl.
*G09G 3/36* (2006.01)
*G09G 3/20* (2006.01)

(52) U.S. Cl.
CPC ..... *G09G 3/2011* (2013.01); *G09G 3/2077* (2013.01); *G09G 2300/0857* (2013.01); *G09G 2330/021* (2013.01); *G09G 3/3648* (2013.01); *G09G 2300/0465* (2013.01); *G09G 2320/10* (2013.01)
USPC ..... 345/98; 345/90; 345/92; 345/204; 345/205

(58) Field of Classification Search
None
See application file for complete search history.

(56) References Cited

U.S. PATENT DOCUMENTS

| | | | | |
|---|---|---|---|---|
| 5,712,652 | A * | 1/1998 | Sato et al. | 345/90 |
| 2002/0036627 | A1 * | 3/2002 | Yokoyama | 345/204 |
| 2004/0066364 | A1 * | 4/2004 | Toyozawa et al. | 345/98 |

FOREIGN PATENT DOCUMENTS

| | | |
|---|---|---|
| JP | 09-243995 | 9/1997 |
| JP | 2002-169137 | 6/2002 |
| JP | 2002-162947 | 7/2002 |
| JP | 2003-076343 | 3/2003 |
| JP | 2003-122331 | 4/2003 |
| JP | 2003-177717 | 6/2003 |
| JP | 2003-228336 | 8/2003 |
| JP | 2003-287764 | 10/2003 |
| JP | 2004-077742 | 3/2004 |
| JP | 2004-191574 | 7/2004 |

* cited by examiner

*Primary Examiner* — Jesus Hernandez
(74) *Attorney, Agent, or Firm* — Robert J. Depke; The Chicago Technology Law Group, LLC

(57) ABSTRACT

An image display apparatus includes a display section having a pixel unit included in a layout of a pixel matrix and provided with a memory unit used for storing a logic level of input image data; a vertical driving section for asserting a scan signal on a scan line provided for the display section; and a horizontal driving section for asserting a driving signal according to the input image data on a signal line provided for the display section.

14 Claims, 21 Drawing Sheets

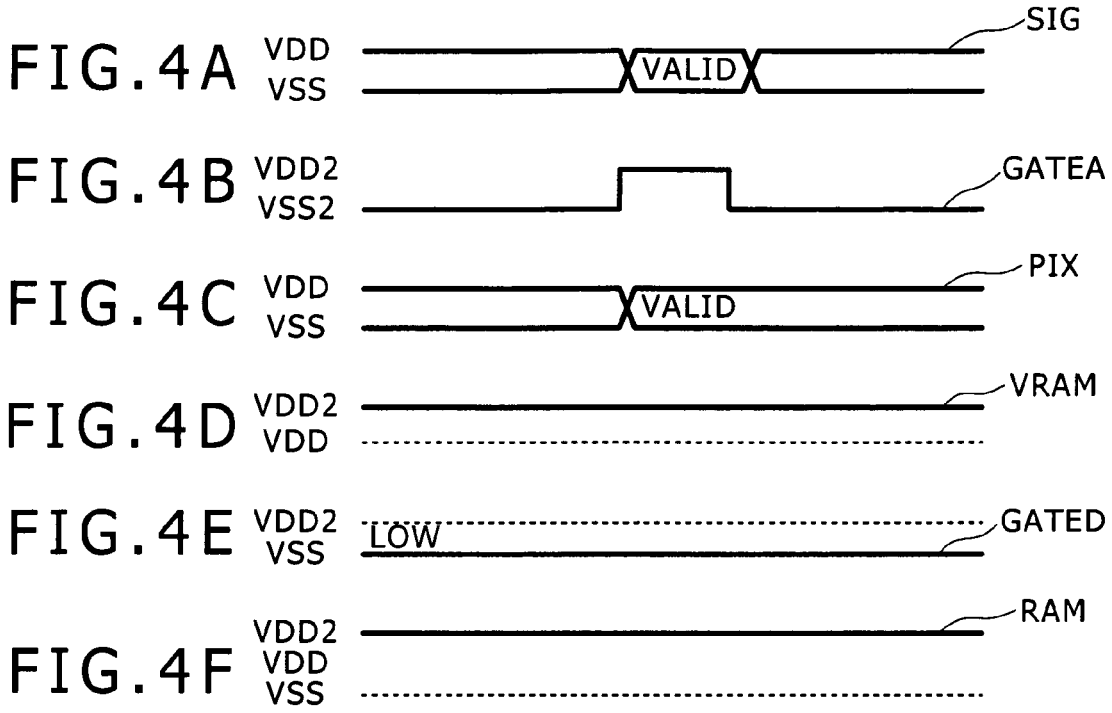
FIG.5
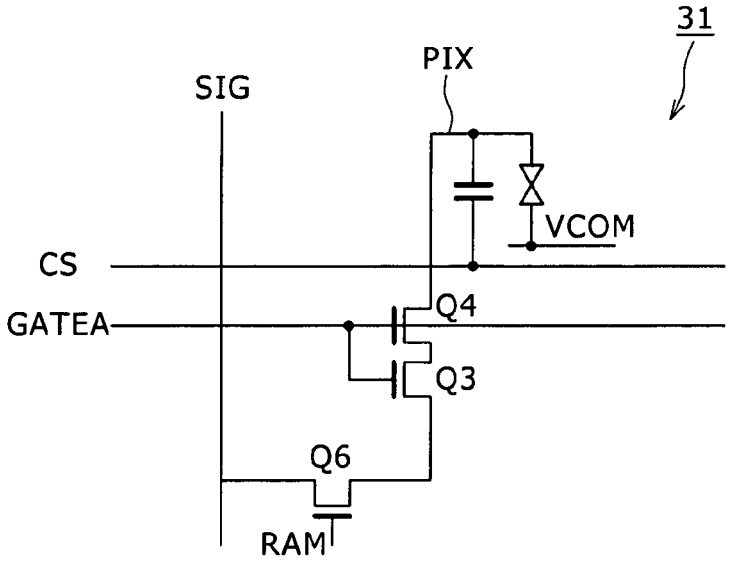

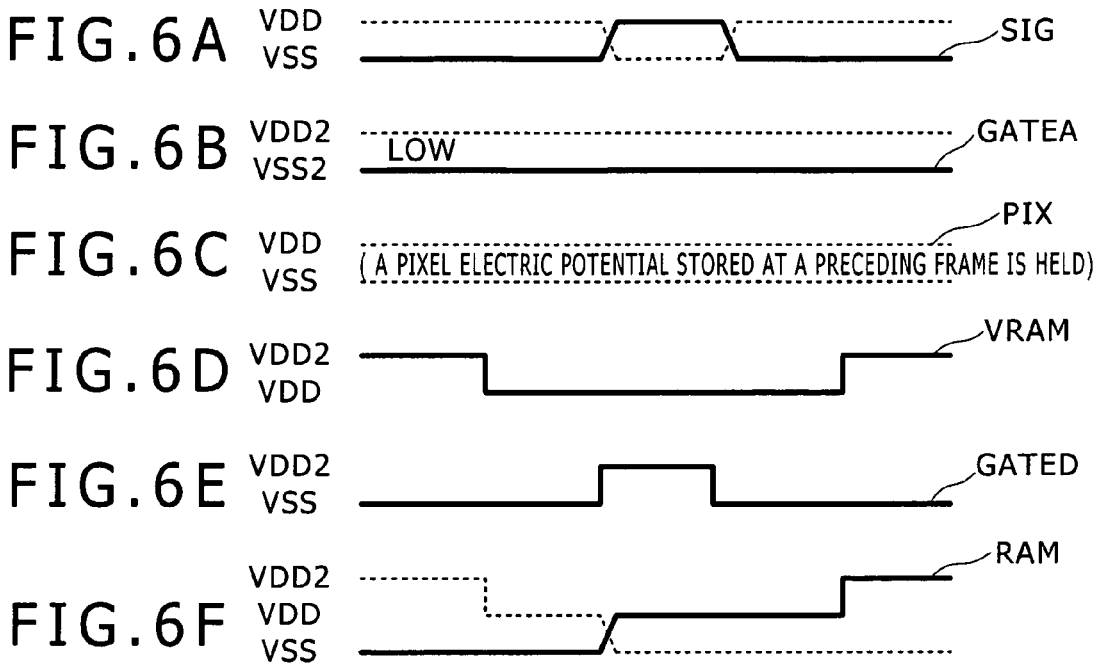
FIG.7
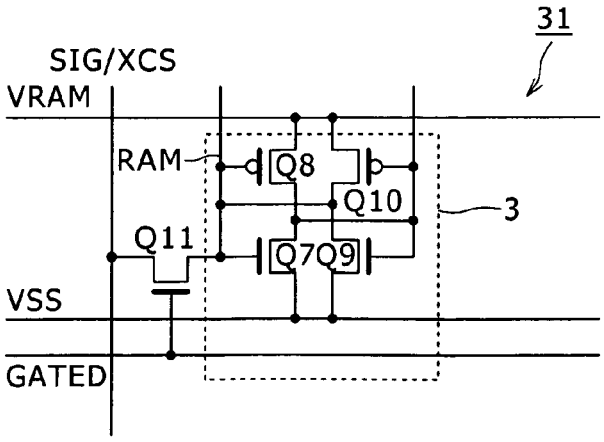

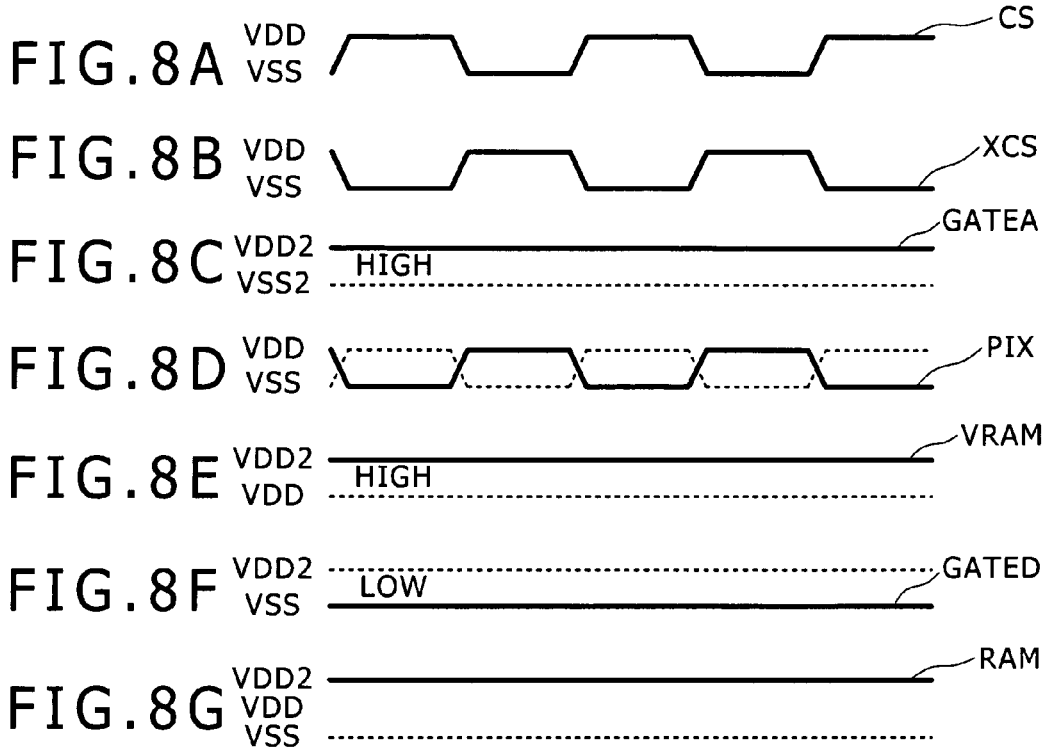
FIG.9
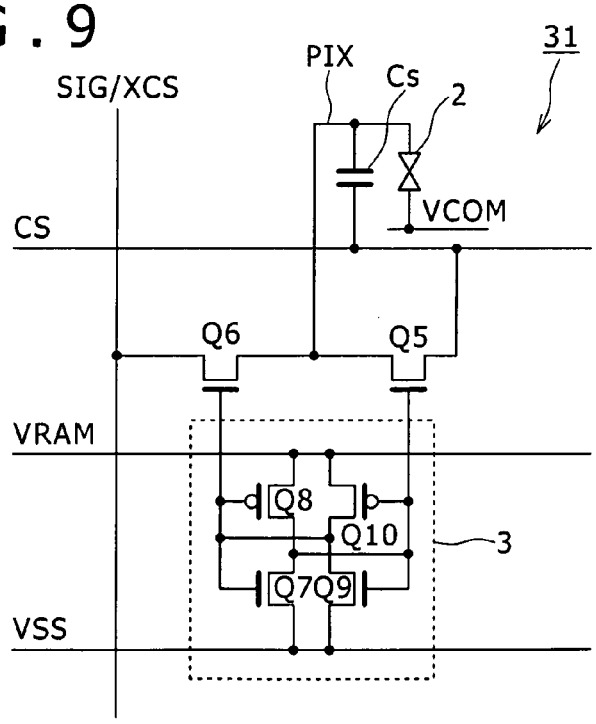

VDD
VSS
R
G
B
SIG
FIG.11B1
VDD2
VSS2
GATER
FIG.11B2
VDD2
VSS2
GATEG
FIG.11B3
VDD2
VSS2
GATEB
FIG.11C1
VDD
VSS
R
PEXR
FIG.11C2
VDD
VSS
R
G
PEXG
FIG.11C3
VDD
VSS
R
G
B
PEXB

VDD2
VDD
HIGH
VRAM

VDD2
VSS
LOW
GATED

VDD2
VDD
VSS
HIGH
RAM

VDD
VSS
SIG
FIG.13B1
VDD2
VSS2
LOW
GATER
FIG.13B2
VDD2
VSS2
LOW
GATEG
FIG.13B3
VDD2
VSS2
LOW
GATEB
FIG.13C1
VDD
VSS
(A PIXEL ELECTRIC POTENTIAL STORED AT A PRECEDING FRAME IS HELD)
PIXR
FIG.13C2
VDD
VSS
(A PIXEL ELECTRIC POTENTIAL STORED AT A PRECEDING FRAME IS HELD)
PIXG
FIG.13C3
VDD
VSS
(A PIXEL ELECTRIC POTENTIAL STORED AT A PRECEDING FRAME IS HELD)
PIXB

VDD2
VDD
VRAM

VDD2
VSS
GATED

VDD2
VDD
VSS
RAM

VDD
VSS
CS

VDD
VSS
XCS
FIG.15C1
VDD2
VSS2
HIGH
GATER
FIG.15C2
VDD2
VSS2
HIGH
GATEG
FIG.15C3
VDD2
VSS2
HIGH
GATEB
FIG.15D1
VDD
VSS
PIXR
FIG.15D2
VDD
VSS
PIXG
FIG.15D3
VDD
VSS
PIXB

VDD2
VDD
HIGH
VRAM

VDD2
VSS
LOW
GATED

VDD2
VDD
VSS
RAM

IMAGE DISPLAY APPARATUS AND IMAGE DISPLAY METHOD

CROSS REFERENCES TO RELATED APPLICATIONS

The present invention contains subject matter related Japanese Patent Application JP 2007-096011 filed in the Japan Patent Office on Apr. 2, 2007, the entire contents of which being incorporated herein by reference.

BACKGROUND OF THE INVENTION

1. Field of the Invention

The present invention relates to an image display apparatus and an image display method. More particularly, the present invention can be applied to an image display apparatus capable of switching the operation from an analog driving mode to a memory mode and vice versa. The present invention allows the opening window of a liquid-crystal cell employed in a pixel cell to be sufficiently widened by making use of a simple configuration utilizing switch circuits each used for connecting a pixel unit to a signal line in the analog driving mode also as switch circuits each used for connecting a liquid-crystal cell employed in a pixel unit to a memory unit employed in the same pixel unit in the memory mode.

2. Description of the Related Art

The existing liquid-crystal display apparatus includes a display section. The display section displays an image on pixel units laid out to form a matrix on the display section. Each of the pixel units includes one of liquid-crystal cells forming the displayed image and a driving circuit which is a circuit for driving the liquid-crystal cells. The display section of the liquid-crystal display apparatus is provided with scan lines each associated with one of pixel rows composing the matrix. In addition, the display section is also provided with signal lines each associated with one of pixel columns composing the matrix. Each of the scan lines crosses the signal lines. In the liquid-crystal display apparatus, a scan signal appearing on a scan line controls pixel units on a row associated with the scan line. The scan lines sequentially control their respective rows. A signal line is connected to liquid-crystal cells each included in one of pixel units on a column associated with the signal line. The gradation of a liquid-crystal cell is determined by the level of a signal appearing on a signal line connected to the liquid-crystal cell. With such a configuration, the liquid-crystal display apparatus displays a desired image. In the following description, the mode of controlling the gradation of a liquid-crystal cell in accordance with the level of a signal appearing on a signal line connected to the liquid-crystal cell is referred to as the analog driving mode cited above.

In accordance with a technology disclosed in Japanese Patent Laid-open No. Hei 9-243995, on the other hand, there is provided a configuration in which each pixel unit is provided with a memory unit used for recording data and the pixel unit is driven in accordance with the data recorded in the memory unit. In the following description, this mode of driving a pixel unit in accordance with data recorded in a memory unit associated with the pixel unit is referred to as the memory mode mentioned above. In the memory mode, once a gradation of each pixel unit has been set, a process to set a gradation for each pixel unit is no longer required. Thus, the power consumption is low in comparison with the analog driving mode.

By the way, a configuration allowing both the memory mode and the analog driving mode to be adopted is considered to be a configuration providing convenience. To put it concretely, in a typical configuration, the analog driving mode is selected for displaying moving and still images whereas the memory mode is selected for displaying monochrome texts. With such a configuration, multi-gradation moving and still images can be displayed at a low power consumption. In the following description, a system allowing both the memory mode and the analog driving mode to be adopted is referred to as a hybrid system.

In the hybrid system, as shown in FIG. 23, each pixel unit 1 provided with a memory unit 3 used in the memory mode has a configuration including a changeover switch circuit for switching the gradation setting operation from the memory mode to the analog driving mode and vice versa and it is conceivable to configure a driving circuit for driving scan lines and a driving circuit for driving signal lines in conformity with the configuration of the pixel unit 1.

To put it concretely, NMOS transistors Q1 and Q2 compose a switch circuit adopting a double-gate technique. This switch circuit is a switch for selecting the analog driving mode. A gate signal DATEA turns on the NMOS transistors Q1 and Q2. The NMOS transistors Q1 and Q2 put in an on state connect a signal line SIG to a liquid-crystal cell 2 and a holding capacitor Cs. As shown by a dashed-line arrow in FIG. 23, in the analog driving mode, an electric potential appearing on a specific one of the terminals of the liquid-crystal cell 2 and an electric potential appearing on a specific one of the terminals of the holding capacitor Cs are each set at the level of a signal appearing on the signal line SIG. The gradation of the liquid-crystal cell 2 is thus determined by the level of a signal appearing on the signal line SIG. It is to be noted that the other terminal of the holding capacitor Cs is connected to a scan line which is connected to a CS driving circuit. The CS driving circuit asserts a pre-charging driving signal CS related to pre-charge processing on the scan line as shown in FIG. 24A. The other terminal of the liquid-crystal cell 2 is referred to as a common electrode of the liquid-crystal cell 2. The common electrode is connected to the common electrodes of liquid-crystal cells 2 each employed in another pixel unit 1 not shown in the figure. A driving power supply VCOM is connected to the common electrode of the liquid-crystal cell 2. The level of a voltage generated by the driving power supply VCOM changes in a manner interlocked with the pre-charging driving signal CS.

In addition, the pixel unit 1 employs NMOS transistors Q3 and Q4 also serving as a switch circuit adopting a double-gate technique. This switch circuit is a switch for selecting the memory mode. A gate signal RM turns on the NMOS transistors Q3 and Q4. The NMOS transistors Q3 and Q4 connect an NMOS Q5 and an NMOS Q6 to the liquid-crystal cell 2 and the holding capacitor Cs. The NMOS Q5 or Q6 selects and outputs the driving signal FRP or XFRP respectively in accordance with the state of a memory unit 3 shown by a dashed-line block in FIG. 23. As shown in FIG. 24B, the driving signal FRP has the same phase as the driving signal CS related to pre-charge processing. As shown in FIG. 24C, on the other hand, the driving signal XFRP has a phase opposite to that of the driving signal CS. In this way, as a substitute for the switch circuit employing the NMOS transistors Q1 and Q2 in the analog driving mode, the switch circuit employing the NMOS transistors Q3 and Q4 can be activated in the memory mode for driving the liquid-crystal cell 2.

It is to be noted that the memory unit 3 has an SRAM (Static Random Access Memory) configuration including a CMOS inverter having an NMOS transistor Q7 and a PMOS transistor Q8 as well as a CMOS inverter having an NMOS transistor Q9 and a PMOS transistor Q10. The gate of the NMOS transistor Q7 is connected to the gate of the NMOS transistor Q8 whereas the drain of the NMOS transistor Q7 is connected to the drain of the NMOS transistor Q8. By the same token, the gate of the NMOS transistor Q9 is connected to the gate of the NMOS transistor Q10 whereas the drain of the NMOS transistor Q9 is connected to the drain of the NMOS transistor Q10. The memory unit 3 is connected to the signal line SIG through an NMOS transistor Q11 turned on by a gate signal GATED and serves as a memory used for storing the logic level of the signal line SIG. The memory unit 3 outputs an output signal RAM representing the stored logic level of the signal line SIG and also outputs an inverted output signal representing the inverted logic level of the output signal RAM.

The inverted output signal is supplied to the gate of the NMOS transistor Q5 whereas the output signal RAM is supplied to the gate of the NMOS transistor Q6. Since the logic level of the inverted output signal is the inverted logic level of the output signal RAM, only either the NMOS transistor Q5 or the NMOS transistor Q6 is turned on to supply either driving signal FRP or XFRP to the switch circuit employing the NMOS transistors Q3 and Q4.

By the way, as described above, since the pixel unit 1 shown in FIG. 23 as a pixel unit in the hybrid system employs switch circuits for switching the gradation setting operation from the memory mode to the analog driving mode and vice versa, the pixel unit 1 has a problem that the number of transistors and the number of scan lines are large, making the configuration complicated. In addition, the pixel unit 1 also has another problem that the opening window of the liquid-crystal cell 2 is narrow.

In the following description, Japanese Patent Laid-open No. Hei 9-243995 mentioned above is referred to as patent document 1.

SUMMARY OF THE INVENTION

In order to solve the problems described above, inventors of the present invention have proposed an image display apparatus employing pixel units each configured to be capable of switching the gradation setting operation from an analog driving mode to a memory mode and vice versa and sufficiently widening the opening window of a liquid-crystal cell thereof by making use of a simple configuration and proposed an image display method for the image display apparatus.

In order to solve the problems described above, in accordance with an embodiment of the present invention, there is provided an image display apparatus. The apparatus employs a display section having a pixel unit included in a layout of a pixel matrix and provided with a memory unit used for recording a logic level of input image data; a vertical driving section for asserting a scan signal on a scan line provided for the display section; and a horizontal driving section for asserting a driving signal according to the input image data on a signal line provided for the display section. In the apparatus, an operation to drive the pixel unit is switched from an analog driving mode to a memory mode and vice versa; in the analog driving mode, the horizontal driving section carries out a digital-to-analog conversion process to convert the input image data into an analog signal and asserts the analog signal on the signal line; in the memory mode, the horizontal driving section properly assigns the input image data to the signal line in order to set the signal line at a logic level of the input image data; in the memory mode, after a logic level of the input image data asserted on the signal line has been recorded in the memory unit, the memory unit is connected to the pixel unit in order to set the gradation of the pixel unit at a value according to the logic level of the input image data; in the analog driving mode, the signal line is connected to the pixel unit in order to set the gradation of the pixel unit at a value according to the level of the driving signal asserted on the signal line; and a switch circuit for connecting the memory unit to the pixel unit in the memory mode is also used as a switch circuit for connecting the signal line to the pixel unit in the analog driving mode.

In order to solve the problems described above, in accordance with another embodiment of the present invention, there is provided an image display method to be adopted in an image display apparatus employing: a display section having a pixel unit included in a layout of a pixel matrix and provided with a memory unit used for recording a logic level of input image data; a vertical driving section for asserting a scan signal on a scan line provided for the display section; and a horizontal driving section for asserting a driving signal according to the input image data on a signal line provided for the display section. The image display method includes the steps of:

switching an operation to drive the pixel unit from an analog driving mode to a memory mode and vice versa;

driving the horizontal driving section to carry out a digital-to-analog conversion process to convert the input image data into an analog signal and assert the analog signal on the signal line in the analog driving mode;

driving the horizontal driving section to properly assign the input image data to the signal line in order to set the signal line at a logic level of the input image data in the memory mode;

connecting the memory unit to the pixel unit in order to set the gradation of the pixel unit at a value according to a logic level of the input image data asserted on the signal line after recording the logic level of the input image data in the memory unit in the memory mode;

connecting the signal line to the pixel unit in order to set the gradation of the pixel unit at a value according to the level of the driving signal asserted on the signal line in the analog driving mode; and making use of a switch circuit for connecting the memory unit to the pixel unit in the memory mode also as a switch circuit for connecting the signal line to the pixel unit in the analog driving mode.

In accordance with the image display apparatus according to the embodiment of the present invention and the image display method according to the other embodiment of the present invention, a switch circuit for connecting the memory unit to the pixel unit in the memory mode is also used as a switch circuit for connecting the signal line to the pixel unit in the analog driving mode. Therefore, the configuration of each pixel can be simplified by reducing the number of the switch circuit.

In accordance with the image display apparatus according to the present invention, each pixel unit is configured to be capable of switching the gradation setting operation from an analog driving mode to a memory mode and vice versa and sufficiently widening the opening window of a liquid-crystal cell thereof by making use of a simple configuration.

BRIEF DESCRIPTION OF THE DRAWINGS

FIGS. 4A to 4F show timing charts of signals generated during operations carried out by the image display apparatus according to the embodiment shown in FIG. 3 as the second embodiment of the present invention in an analog driving mode;

FIG. 5 shows a portion of the pixel unit employed in the image display apparatus according to the embodiment shown in FIG. 3 as the second embodiment operating in the analog driving mode;

FIGS. 6A to 6F show timing charts of signals generated during operations carried out by the image display apparatus according to the embodiment shown in FIG. 3 as the second embodiment of the present invention in a memory mode;

FIG. 7 shows a portion of the pixel unit employed in the image display apparatus according to the embodiment shown in FIG. 3 as the second embodiment operating in the memory mode;

FIGS. 8A to 8G show other timing charts of the signals generated during operations carried out by the image display apparatus according to the embodiment shown in FIG. 3 as the second embodiment of the present invention in the memory mode;

FIG. 9 shows the pixel unit employed in the image display apparatus according to the embodiment shown in FIG. 3 as the second embodiment operating in the memory mode;

FIGS. 11A to 11F show timing charts of signals generated during operations carried out by the image display apparatus according to the embodiment shown in FIG. 10 as the third embodiment of the present invention in an analog driving mode;

FIGS. 13A to 13F show timing charts of signals generated during operations carried out by the image display apparatus according to the embodiment shown in FIG. 10 as the third embodiment of the present invention in the memory mode;

FIGS. 15A to 15G show other timing charts of the signals generated during operations carried out by the image display apparatus according to the embodiment shown in FIG. 10 as the third embodiment of the present invention in the memory mode;

FIGS. 21A to 21D3 show timing charts of signals generated during operations carried out by the image display apparatus according to the embodiment shown in FIG. 20 as the sixth embodiment of the present invention in the memory mode;

DETAILED DESCRIPTION OF THE PREFERRED EMBODIMENTS

Preferred embodiments of the present invention will be explained by referring to diagrams as follows.

First Embodiment

1. Configuration of the First Embodiment

Figure 2:
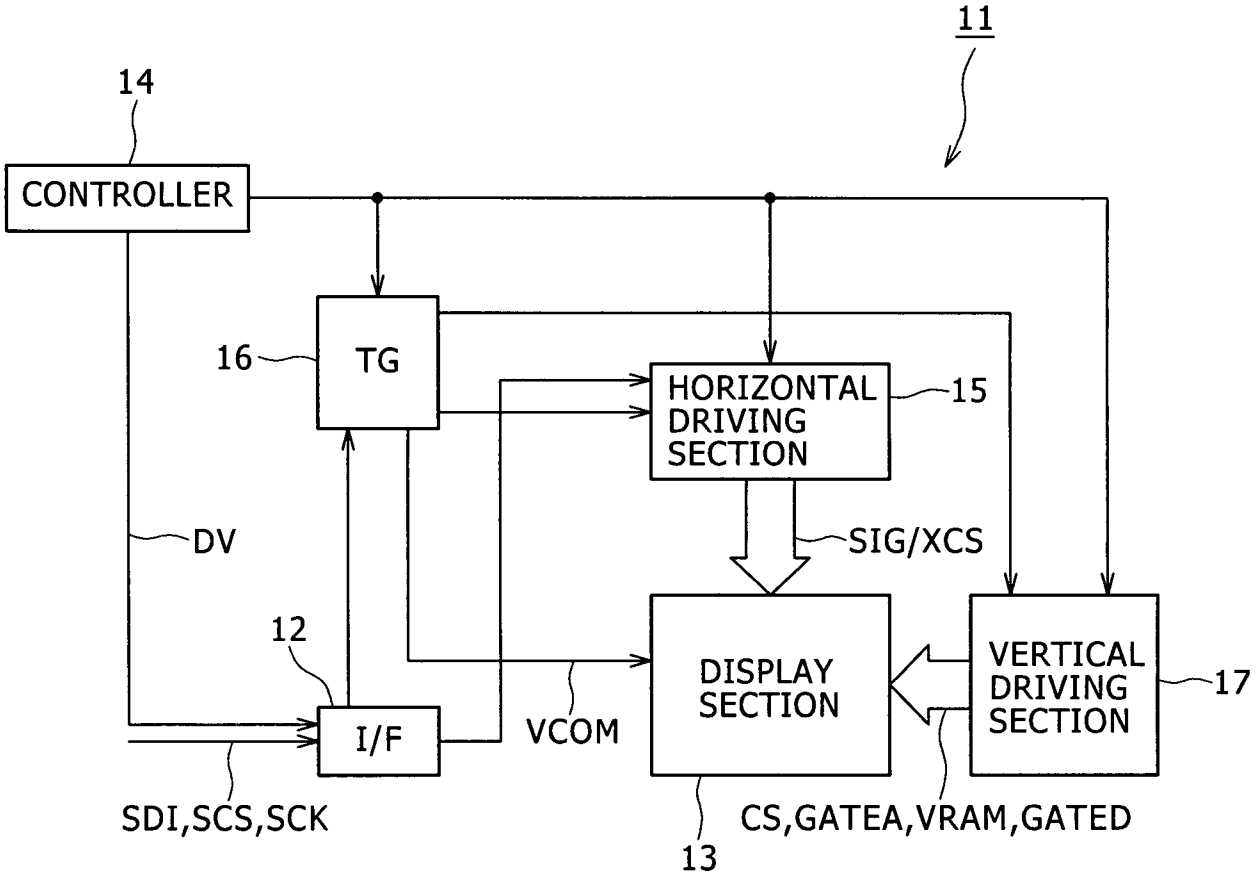
FIG. 2 is a block diagram showing the image display apparatus according to the first embodiment of the present invention.

FIG. 2 is a block diagram showing an image display apparatus 11 according to a first embodiment of the present invention. In the analog driving mode, the image display apparatus 11 displays typically a moving or standstill image based on video data output by either of a tuner, an external apparatus and the like, which are not shown in the figure, on a display section 13. In the memory mode, on the other hand, the image display apparatus 11 displays typically a variety of menus on the display section 13.

In the image display apparatus 11, an interface (IF) 12 receives serial image data SDI sequentially representing gradation of pixel units, a system clock signals SCK synchronized with the serial image data SDI and a timing signal SCS synchronized with a vertical synchronization signal. It is to be noted that the serial image data SDI is image data displayed on the display section 13 in the analog driving mode. In addition, the interface 12 also receives binary image data DV to be displayed on the display section 13 in the memory mode from a controller 14. The interface 12 outputs these various input signals such as the serial image data SDI and the binary image data DV to a horizontal driving section 15 and a TG (Timing Generator) 16 in accordance with control executed by the controller 14.

In accordance with control executed by the controller 14, the timing generator 16 outputs a variety of timing signals required in the memory mode and the analog driving mode to the horizontal driving section 15 and a vertical driving section 17. In addition, the timing generator 16 also outputs a driving power-supply voltage VCOM to the display section 13 as a voltage shared by common electrodes of liquid-crystal cells each employed in a pixel unit included in the display section 13. It is to be noted that, as the liquid-crystal cell according to the embodiment, it is possible to make use of a cell with any of a reflection type, a transmission type, and a combination type of a reflection type and a transmission type.

In accordance with control executed by the controller 14, the horizontal driving section 15 switches the gradation setting operation from the analog driving mode to the memory mode and vice versa. In the analog driving mode, the horizontal driving section 15 sequentially apportions the serial image data SDI received from the interface 12 among signal lines SIG and carries out a digital-to-analog process to convert the serial image data SDI into analog signals each used as a driving signal for driving one of the signal lines SIG in processing such as field-inversion, frame-inversion and line-inversion processes. In the analog driving mode, the horizontal driving section 15 outputs the driving signals to their respective signal lines SIG of the display section 13.

In the memory mode, on the other hand, the horizontal driving section 15 outputs a predetermined driving signal XCS to a signal line SIG after supplying corresponding binary image data received from the controller 14 to the signal line SIG in order to set the signal line SIG at the logic level of the input image data. It is to be noted that, in the following description, a driving signal asserted on a signal line SIG in the analog driving mode and image data supplied to a signal line in the memory mode are both properly referred to as the code of the signal line SIG.

In accordance with control executed by the controller 14, the vertical driving section 17 also switches the gradation setting operation from the analog driving mode to the memory mode or vice versa and asserts a predetermined driving signal on each scan line of the display section 13.

Figure 1:
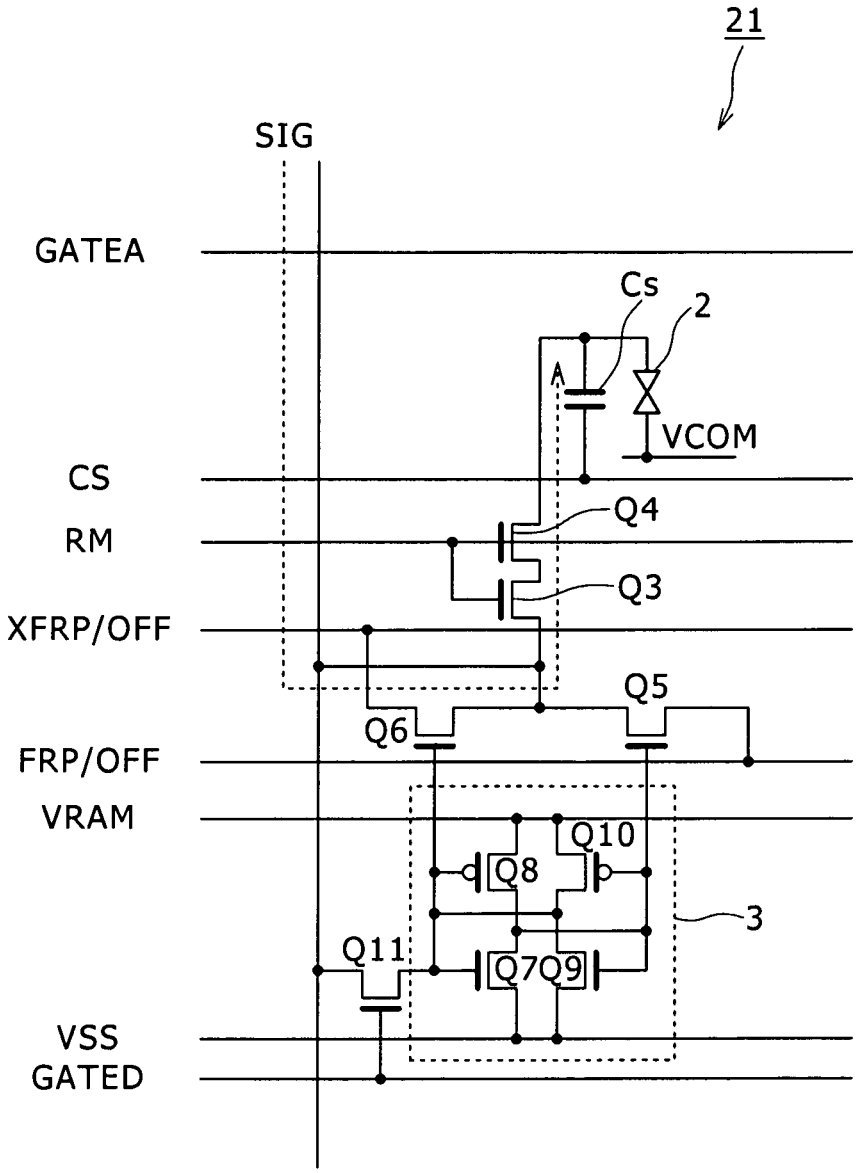
FIG. 1 is a wiring diagram showing the configuration of a pixel unit employed in an image display apparatus according to a first embodiment of the present invention.
Figure 23:
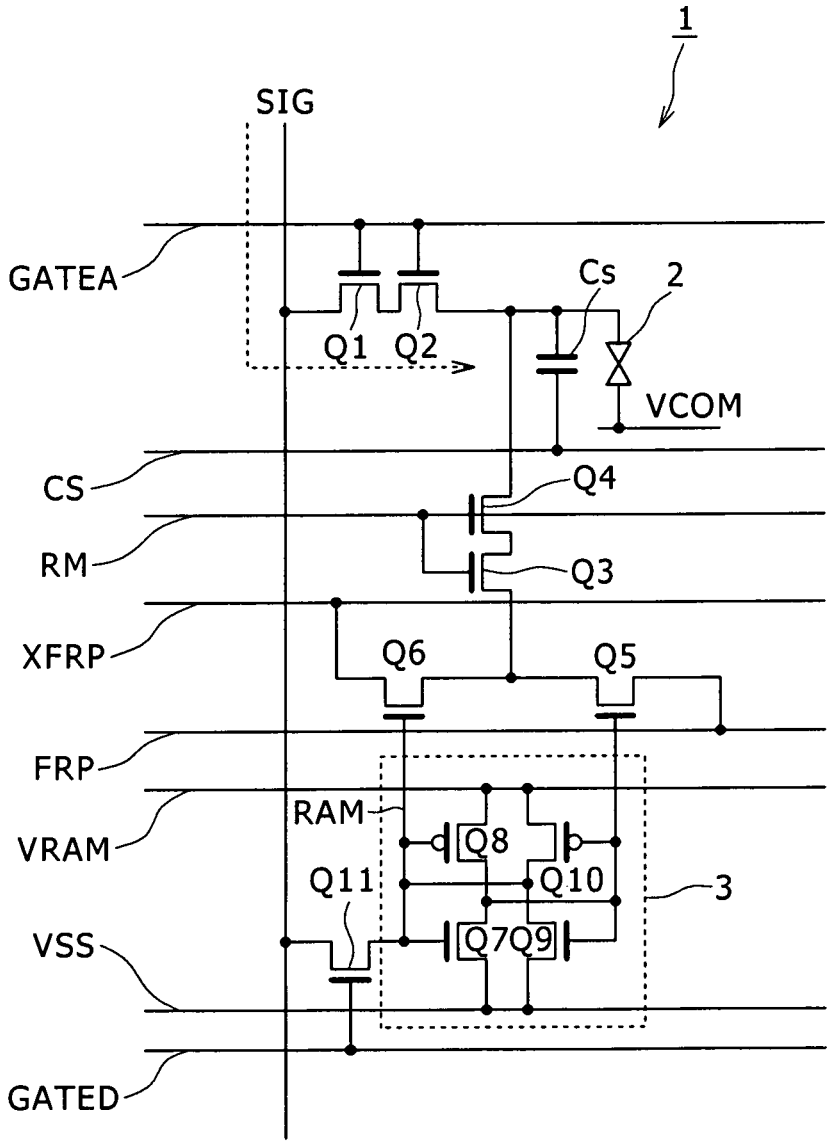
FIG. 23 is a wiring diagram showing a conceivable hybrid pixel unit capable of operating in both an analog driving mode and a memory mode.
Figures 24A, 24B, 24C:
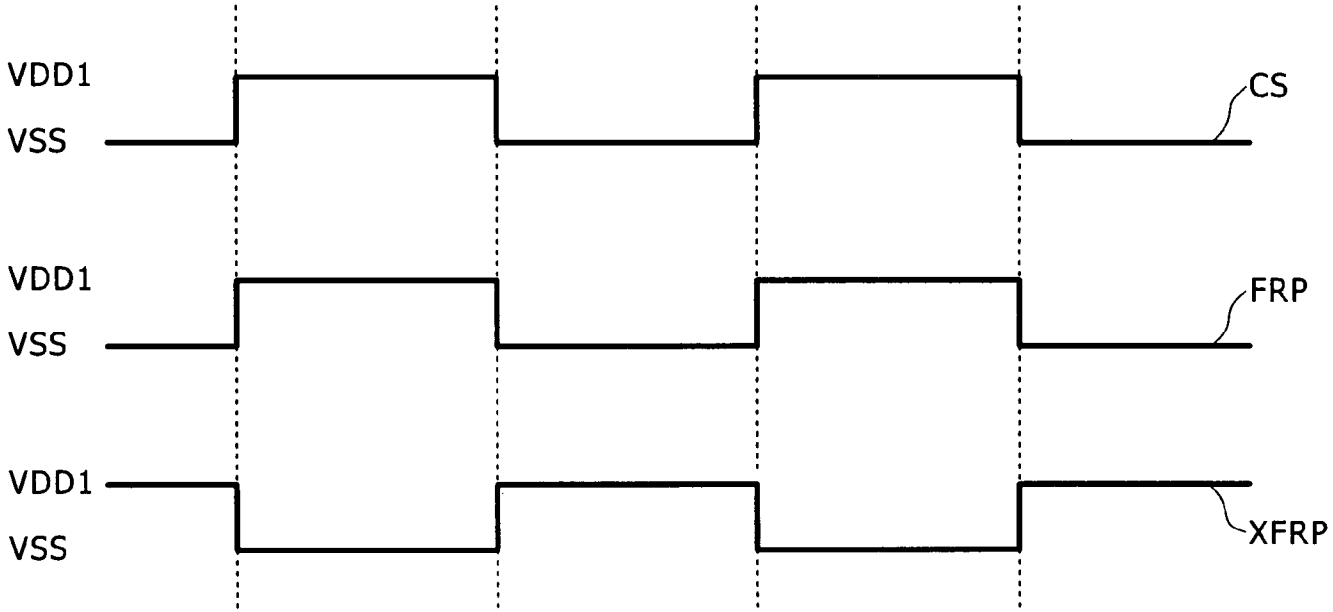
FIGS. 24A to 24C show timing charts of signals generated during operations carried out by a pixel unit employed in the hybrid image display apparatus shown in FIG. 23.

The display section 13 operates in accordance with a variety of signals received from the horizontal driving section 15 and the vertical driving section 17 in order to display an image based on the serial image data SDI or the binary image data DV. The display section 13 includes a matrix of pixel units 21 shown in FIG. 1 as pixel units replacing those shown in FIG. 23. The pixel unit 21 shown in FIG. 1 does not employ the switch circuit including the transistors Q1 and Q2 for connecting the liquid-crystal cell 2 to the signal line SIG in the analog driving mode. Instead, the liquid-crystal cell 2 is connected to the signal line SIG through the switch circuit including the transistors Q3 and Q4, which used to be utilized for selecting the memory mode. To put it concretely, the transistors Q3 and Q4 connect the liquid-crystal cell 2 to the signal line SIG which is also directly wired to the transistors Q5 and Q6. That is to say, the pixel unit 21 shown in FIG. 1 is identical with the pixel unit 1 shown in FIG. 23 except the difference described above as a difference in switching-circuit configuration. For this reason, components employed in the pixel unit 21 shown in FIG. 1 as components identical with their respective counterparts included in the pixel unit 1 shown in FIG. 23 are denoted by the same reference numerals and the same notations as the counterparts. In addition, the identical components are not explained again to avoid duplications of description.

In the analog driving mode, the vertical driving section 17 stops an operation to supply driving the signals FRP and XFRP to the transistors Q5 and Q6 respectively during a period in which the level of the signal line SIG is being applied to a terminal of the liquid-crystal cell 2 so as to prevent both the transistors Q5 and Q6 from passing on the signals FRP and XFRP respectively during this period. To put it concretely, during the period, the level of a signal appearing on each of scan lines supplying the driving signals FRP and XFRP is sustained at a predetermined voltage OFF. In addition, during the same period, the vertical driving section 17 is sustaining a gate signal RM at a predetermined electric potential for turning on the transistors Q3 and Q4 composing the switch circuit. Thus, as shown by a dashed-line arrow in FIG. 1, in the analog driving mode, an electric potential appearing on a specific one of the terminals of the holding capacitor Cs employed in the pixel unit 21 is sustained at the level of the signal line SIG. By the same token, an electric potential appearing on a specific one of the terminals of the liquid-crystal cell 2 employed in the pixel unit 21 is also sustained at the level of the signal line SIG so that the gradation of the liquid-crystal cell 2 is set at a value determined by the level of the signal line SIG.

In the memory mode, on the other hand, image data DV is stored in the memory unit 3 and a switch circuit included in the pixel unit 21 as the switch circuit employing the transistors Q3 and Q4 is sustained in an off state. In addition, the level of a signal appearing on a scan line supplying the driving signals FRP and XFRP is sustained at the predetermined voltage OFF which is supplied to the transistors Q5 and Q6. However, the transistor Q11 is turned on in order to set the logic level of a signal appearing on the signal line SIG in the memory unit 3.

Then, in the same memory mode, a terminal employed by the horizontal driving section 15 as a terminal connected to the signal line SIG is put in a high-impedance state and the switch circuit including the transistors Q3 and Q4 is turned on. In addition, an operation to supply the driving signals FRP and XFRP to the transistors Q5 and Q6 respectively is started. Thus, a selected one of the driving signal FRP or XFRP is applied to the liquid-crystal cell 2 employed in the pixel unit 21 through the transistors Q3 and Q4. Either the driving signal FRP having the same phase as the pre-charging driving signal CS related to pre-charge processing or the driving signal XFRP having a phase opposite to that of the pre-charging driving signal CS is selected in accordance with the logic level stored in the memory unit 3 as a driving signal to be applied to the liquid-crystal cell 2 through the transistors Q3 and Q4. As a result, the gradation of the liquid-crystal cell 2 as set at a value determined by the binary image data DV.

It is to be noted that, in conformity with the configuration of the pixel unit 21, the horizontal driving section 15 and the vertical driving section 17 sequentially set the level of a signal appearing on the signal line SIG as well as a logic level and sequentially switches a driving signal to be asserted on the scan line of each row so as to set the gradation of the liquid-crystal cell 2 employed in the pixel unit 21 sequentially from row to row.

2. Operations of the Embodiment

The image display apparatus 11 having the configuration described above by referring to FIG. 2 displays a moving or standstill image based on video data output by a tuner, an external apparatus or the like on the display section 13 by carrying out operations described as follows. In accordance with control executed by the controller 14 on a variety of components employed in the image display apparatus 11, image data SDI input by the interface 12 is supplied to the horizontal driving section 15. The horizontal driving section 15 carries out a digital-to-analog process to convert the serial image data SDI into analog signals each used as a driving signal for driving one of the signal lines SIG in processing such as field-inversion, frame-inversion and line-inversion processes. In this case, if the controller 14 sets the analog driving mode in the image display apparatus 11, the transistors Q5 and Q6 are both kept in an off state. As described earlier, the transistors Q5 and Q6 are transistors for selecting either the driving signal FRP having the same phase as the pre-charging driving signal CS related to pre-charge processing or the driving signal XFRP having a phase opposite to that of the pre-charging driving signal CS in the memory mode. With the transistors Q5 and Q6 both kept in an off state in the analog driving mode, the switch circuit employing the transistors Q3 and Q4 is sustained in an on state so that the signal line SIG is connected to the liquid-crystal cell 2 through the transistors Q3 and Q4. Thus, a voltage appearing on a specific one of the terminals of the liquid-crystal cell 2 is set at the level of a signal appearing on the signal line SIG. As a result, in the image display apparatus 11 set in the analog driving mode, a moving or standstill image based on the serial image data SDI is displayed on the display section 13 by adoption of a multi-gradation technique.

In an operation to display typically the image of a menu received from the controller 14 for example, first of all, the controller 14 supplies binary image data DV to the horizontal driving section 15 by way of the interface 12 in a memory mode. In the image display apparatus 11, the logic levels of signals appearing on the signal lines SIG are set sequentially in accordance with the logic levels of the binary image data DV. In order to avoid effects of the logic level of a signal appearing along the signal line SIG on the liquid-crystal cell 2, the transistors Q3 and Q4 are each put in a turned-off state. With the transistors Q5 and Q6 each turned off, the transistor Q11 is turned on in order to connect the signal line SIG to the memory unit 3 employing the transistors Q7 to Q10. In this state, the logic level of the signal appearing on the signal line SIG is stored in the memory unit 3.

Then, later on, the transistors Q3 and Q4 are each put in a turned-on state whereas the driving signal FRP having the same phase as the pre-charging driving signal CS related to pre-charge processing and the driving signal XFRP having a phase opposite to that of the pre-charging driving signal CS are supplied to the transistors Q5 and Q6 respectively. However, only the transistor Q5 or Q6 is selectively turned on in accordance with the logic level stored in the memory unit 3. Thus, either the driving signal FRP or XFRP is selected by the transistor Q5 or Q6 respectively and supplied to the liquid-crystal cell 2 by way of the switch circuit employing the transistors Q3 and Q4. In this way, with the image display apparatus 11 set in the memory mode, the display section 13 is capable of displaying a menu screen or the like.

By the way, the configuration shown in FIG. 23 can be compared with the configuration shown in FIG. 1 as a configuration according to the embodiment as follows. First of all, the switch circuit provided with the transistors Q1 and Q2 as a circuit for selecting the analog driving mode is eliminated from the configuration according to the embodiment. Instead, the switch circuit employing the transistors Q3 and Q4 on the memory side is used also to carry out the function of the eliminated switching circuit. By employing this switch circuit as a dual-function switch circuit in this way, the number of transistors employed in the image display apparatus 11 can be reduced from 11 to 9. Thus, the configuration of the image display apparatus 11 can be simplified as much as the eliminated transistors. As a result, the opening window of the liquid-crystal cell 2 can be widened.

3. Effects of the Embodiment

By designing the pixel unit into a configuration allowing both the analog driving mode and the memory mode to be adopted as described above, the switch circuit for selecting the memory mode can be used also as the switching circuit for selecting the analog driving mode. Thus, the configuration of the pixel unit 21 can be simplified and, as a result, the opening window of the liquid-crystal cell 2 can be widened.

To put it concretely, the pixel unit 21 is designed into a configuration having switch circuits used in the memory mode. The switch circuits used in the memory mode are:

a switch circuit employing the transistor Q11 for connecting the memory unit 3 to the signal line SIG and storing the logic level of input image data DV appearing on the signal line SIG into the memory unit 3;

a switch circuit employing the transistors Q5 and Q6 for selecting respectively either the driving signal FRP or XFRP with phases opposite to each other in accordance with the logic level stored in the memory unit 3 and outputting the selected driving signal FRP or XFRP to the liquid-crystal cell 2 by way of a switch circuit employing the transistors Q3 and Q4; and the switch circuit employing the transistors Q3 and Q4 for connecting the switch circuit employing the transistors Q5 and Q6 to the liquid-crystal cell 2 and setting the gradation of the liquid-crystal cell 2 in accordance with the driving signal FRP or XFRP which has been selected in accordance with the logic level stored in the memory unit 3.

In the analog driving mode, the switch circuit employing the transistors Q3 and Q4 is also used as a circuit for connecting the signal line SIG to the liquid-crystal cell 2. Thus, the configuration of the pixel unit 21 can be simplified and, as a result, the opening window of the liquid-crystal cell 2 can be widened.

Second Embodiment

Figure 3:
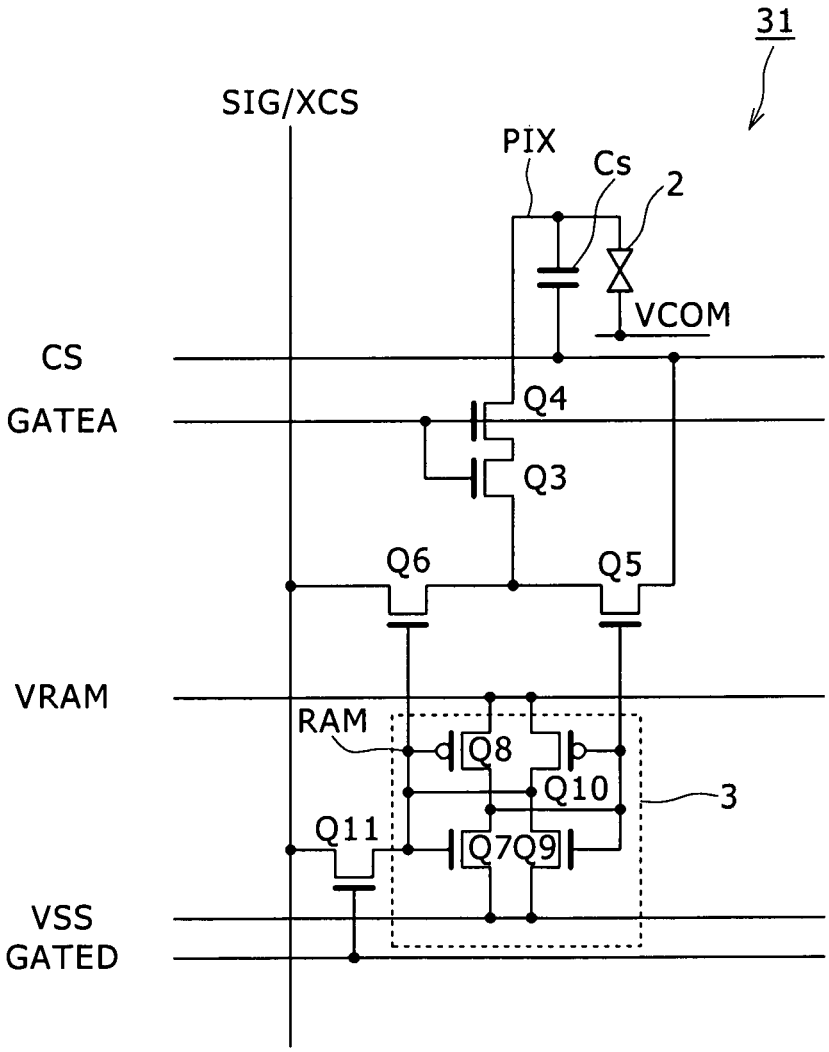
FIG. 3 is a wiring diagram showing a pixel unit employed in an image display apparatus according to a second embodiment of the present invention.

FIG. 3 is a wiring diagram showing a pixel unit employed in an image display apparatus according to a second embodiment of the present invention. In other words, the image display apparatus according to the second embodiment employs a display section including a matrix of pixel units 31 each having a configuration shown in the figure. The pixel unit 31 employed in the image display apparatus according to the second embodiment has a configuration identical with the pixel unit 21 employed in the image display apparatus according to the first embodiment except the vertical and horizontal driving sections for driving the matrix of pixel units 31. For this reason, components employed in the pixel unit 31 shown in FIG. 3 as components identical with their respective counterparts included in the pixel unit 21 shown in FIG. 1 and the pixel unit 1 shown in FIG. 23 are denoted by the same reference numerals and the same notations as the counterparts. In addition, the identical components are not explained again to avoid duplications of description.

In the pixel unit 31, the transistor Q6 is wired to the signal line SIG. Thus, a driving signal XCS having a phase opposite to the phase of the pre-charging driving signal CS related to pre-charge processing can be supplied to the transistor Q6 through the signal line SIG.

First of all, in the analog driving mode, as shown in FIG. 3, an H logic level for initial setting of the transistor Q6 is stored in advance in the memory unit 3 employed in the pixel unit 31 through the signal line SIG and the transistor Q11 driven by a gate signal GATED shown in FIG. 4E. As shown in FIG. 5, the H logic level stored in advance in the memory unit 3 is supplied to the gate of the transistor Q6 as a voltage RAM shown in FIG. 4F in order to selectively drive the transistor Q6 wired to the signal line SIG to operate in an on state. Then, a gate signal GATEA shown in FIG. 4B drives the transistors Q3 and Q4 employed in the pixel unit 31 to operate in an on state. In this state, the liquid-crystal cell 2 is electrically connected to the signal line SIG through the transistors Q6, Q3 and Q4 so that the level of a signal now appearing on the signal line SIG shown in FIG. 4A is stored in a particular one of the terminals of the liquid-crystal cell 2. It is to be noted that notation PIX shown in FIG. 5 denotes a signal appearing on the particular terminal of the liquid-crystal cell 2, that is, the terminal on the transistor-Q4 side. The timing chart of the signal PIX is shown in FIG. 4C. In addition, the H logic level for the initial setting of the transistor Q6 is stored in advance in the memory unit 3 as described above in the same process as a process to store a logic level into the memory unit 3 in the memory mode to be described by referring to FIGS. 6 and 7 as follows.

In the memory mode, on the other hand, the logic level of a signal appearing on the signal line SIG is stored in the memory unit 3 as follows. As shown in FIG. 6B, the gate signal GATEA is sustained at a low level in order to keep the transistors Q3 and Q4 employed in the pixel unit 31 in a turned-off state. In this state, a power-supply voltage VRAM shown in FIG. 6D as the power-supply voltage of the memory unit 3 is pulled down to a voltage VDD conforming to the H level VDD shown in FIG. 6F as a level of a signal appearing on the signal line SIG. Later on, the signal line SIG shown in FIG. 6A is kept at the logic level of current image data DV whereas the gate signal GATED shown in FIG. 6E is sustained at a high level in order to keep the transistor Q11 employed in the pixel unit 31 in an on state. In this state, the memory unit 3 is electrically connected to the signal line SIG, allowing the logic level of a signal appearing on the signal line SIG to be stored in the memory unit 3 as indicated by the voltage RAM shown in FIG. 6F. Later on, the gate signal GATED shown in FIG. 6E is changed to a low level in order to put the transistor Q11 employed in the pixel unit 31 in an off state. In this state, the power-supply voltages VRAM and RAM shown in FIGS. 6D and 6F respectively as the power-supply voltages of the memory unit 3 are raised to a voltage VDD2 corresponding to a driving voltage of the liquid-crystal cell 2. Thus, the transistor Q5 or Q6 connected to the liquid-crystal cell 2 through the transistors Q3 and Q4 can be controlled to turn on and off.

FIGS. 8A to 8G show timing charts of subsequent image displaying operations carried out in the memory mode. A driving signal XCS shown in FIG. 8B as a signal having a phase opposite to the phase of the pre-charging driving signal CS shown in FIG. 8A as a signal related to pre-charge processing is supplied to the signal line SIG. Thus, in accordance with a logic level already stored in the memory unit 3 as the logic level of a signal appearing on the signal line SIG, either the transistor Q5 or Q6 is selected as a transistor to operate in the pixel unit 31 shown in FIG. 9 in order to supply respectively the pre-charging driving signal CS related to pre-charge processing or the driving signal XCS having a phase opposite to the phase of the pre-charging driving signal CS to the switch circuit employing the transistors Q3 and Q4.

The gate signal GATEA shown in FIG. 8C puts the transistors Q3 and Q4 in an on state. Thus, the pre-charging driving signal CS related to pre-charge processing or the driving signal XCS having a phase opposite to the phase of the pre-charging driving signal CS is supplied to the liquid-crystal cell 2 employed in the pixel unit 31 by way of the switch circuit employing the transistors Q3 and Q4. As a result, the liquid-crystal cell 2 is set at a binary gradation determined by a logic level already stored in the memory unit 3 as the logic level of a signal appearing on the signal line SIG.

It is to be noted that, in conformity with the configuration of the pixel unit 31, the horizontal driving section 15 and the vertical driving section 17 sequentially set the level of a signal appearing on the signal line SIG as well as a logic level and sequentially switches a driving signal to be asserted on the scan line of each row as well as the signal line of each column so as to set the gradation of the liquid-crystal cell 2 employed in the pixel unit 31 sequentially from row to row.

To put it concretely, in the analog driving mode, after outputting a logic level for initial setting required to put the transistor Q6 in an on state to the signal line SIG, the horizontal driving section 15 asserts a driving signal on the signal line SIG as an analog signal determining the gradation of the liquid-crystal cell 2. In the memory mode, on the other hand, after logic levels are stored in pixel units 31 connected to a signal line SIG on a time-division basis, the driving signal XCS having a phase opposite to the phase of the pre-charging driving signal CS related to pre-charge processing is output to the signal line SIG. It is to be noted that the logic level for the initial setting of the transistor Q6 is stored in advance in the memory unit 3 in the analog driving mode in the same process as a process to store a logic level of image data DV into the memory unit 3 sequentially row after row in the memory mode. As an alternative to this sequential process, the logic level for the initial setting of the transistor Q6 is stored in advance in the memory unit 3 in the analog driving mode for all rows at one time.

In accordance with this embodiment, the switch circuit for selecting the memory mode is also used as the switch circuit for selecting the analog driving mode. That is to say, in this embodiment, the level of a signal appearing on the signal line SIG is supplied to the liquid-crystal cell 2 in the analog driving mode through the transistor Q6 wired to the signal line SIG as a transistor for receiving the driving signal XCS having a phase opposite to the phase of the pre-charging driving signal CS related to pre-charge processing in the memory mode. However, the second embodiment also has a simple configuration requiring fewer transistors and providing a wider opening window of the liquid-crystal cell 2 as is the case of the first embodiment. In addition, the number of scan lines in this embodiment is reduced to 5 from 8 for the pixel unit 1 shown in FIG. 23. The reduction of the scan line count also results in a simple configuration which also provides a wider opening window of the liquid-crystal cell 2 as well.

Third Embodiment

Figure 10:
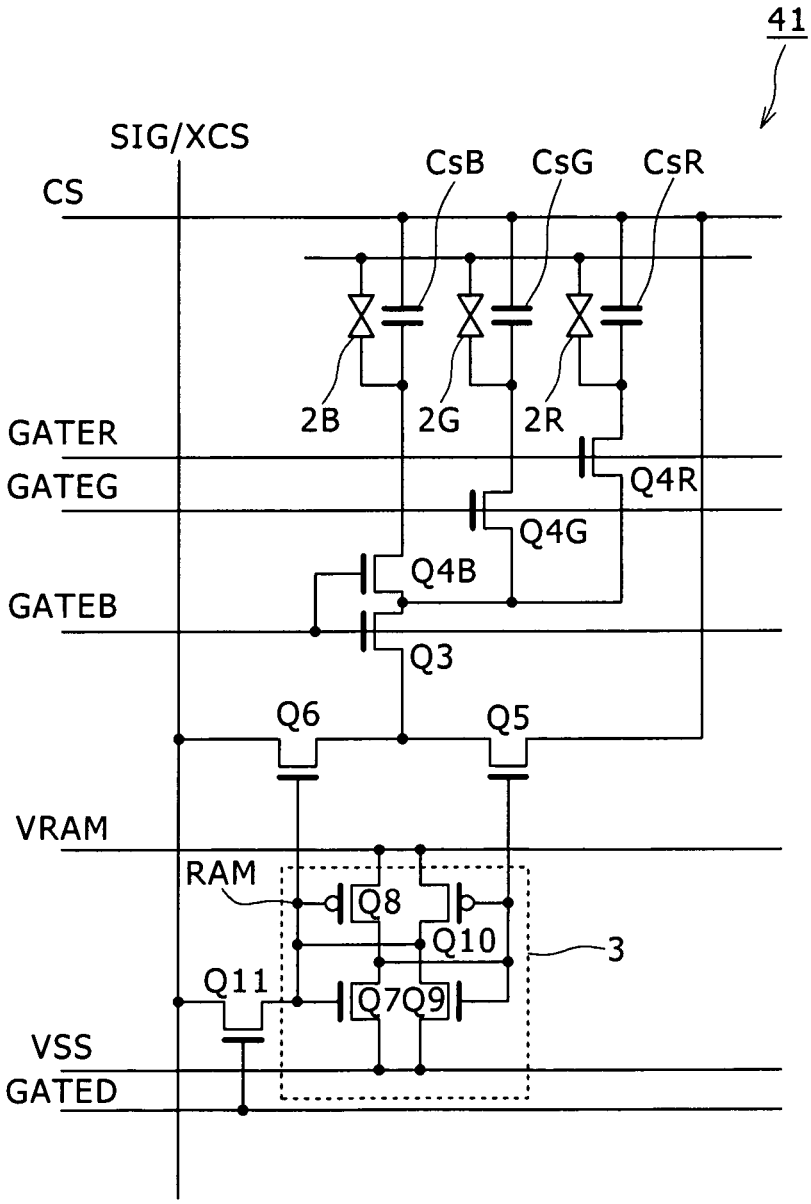
FIG. 10 shows a pixel unit employed in an image display apparatus according to a third embodiment.

FIG. 10 is a wiring diagram showing a display section employed in an image display apparatus according to a third embodiment of the present invention. In other words, the image display apparatus according to the third embodiment employs a display section including a matrix of pixel units 41 each having a configuration shown in the figure. The pixel unit 41 employed in the image display apparatus according to the third embodiment has a configuration identical with the pixel unit 31 employed in the image display apparatus according to the second embodiment except the vertical and horizontal driving sections for driving the matrix of pixel units 41. For this reason, components employed in the pixel unit 41 shown in FIG. 10 as components identical with their respective counterparts included in the pixel unit 31 shown in FIG. 3, the pixel unit 21 shown in FIG. 1 and the pixel unit 1 shown in FIG. 23 are denoted by the same reference numerals and the same notations as the counterparts. In addition, the identical components are not explained again to avoid duplications of description.

In the case of the third embodiment, however, a memory unit 3 is provided for a plurality of liquid-crystal cells 2 as a memory common to the liquid-crystal cells 2. In the memory mode, the gradation of all the liquid-crystal cells 2 associated with a memory unit 3 or the gradation of some of the liquid-crystal cells 2 associated with a memory unit 3 are set in accordance with a logic level stored in the memory unit 3. To put it more concretely, the liquid-crystal cells 2 associated with a memory unit 3 are a red-color liquid-crystal cell 2R, a green-color liquid-crystal cell 2G and a blue-color liquid-crystal cell 2B which are liquid-crystal cells of sub-pixel units composing a pixel unit of a color image. Thus, in the case of the third embodiment, image data SDI of the analog driving mode is supplied to each sub-pixel unit whereas image data DV of the memory mode is supplied to every memory unit 3.

To put it in detail, in the pixel unit 41, the red-color liquid-crystal cell 2R and a red-color holding capacitor CsR form a parallel circuit connected to a transistor Q3 through a transistor Q4R. By the same token, the green-color liquid-crystal cell 2G and a green-color holding capacitor CsG form a parallel circuit connected to the transistor Q3 through a transistor Q4G. In the same way, the blue-color liquid-crystal cell 2B and a blue-color holding capacitor CsB form a parallel circuit connected to the transistor Q3 through a transistor Q4B. The transistor Q3 is connected to the transistor Q5 for outputting the pre-charging driving signal CS and the transistor Q6 for outputting the driving signal XCS having a phase opposite to the phase of the pre-charging driving signal CS. Driven by a gate signal GATER to turn on and off, the red-color transistor Q4R connected to the parallel circuit consisting of the red-color liquid-crystal cell 2R and the red-color holding capacitor CsR forms a switch circuit in conjunction with the transistor Q3. By the same token, driven by a gate signal GATEG to turn on and off, the green-color transistor Q4G connected to the parallel circuit consisting of the green-color liquid-crystal cell 2G and the green-color holding capacitor CsG forms a switch circuit in conjunction with the transistor Q3. In the same way, driven by a gate signal GATEB to turn on and off, the blue-color transistor Q4B connected to the parallel circuit consisting of the blue-color liquid-crystal cell 2B and the blue-color holding capacitor CsB forms a switch circuit in conjunction with the transistor Q3.

Figures 11A, 11D, 11E, 11F:
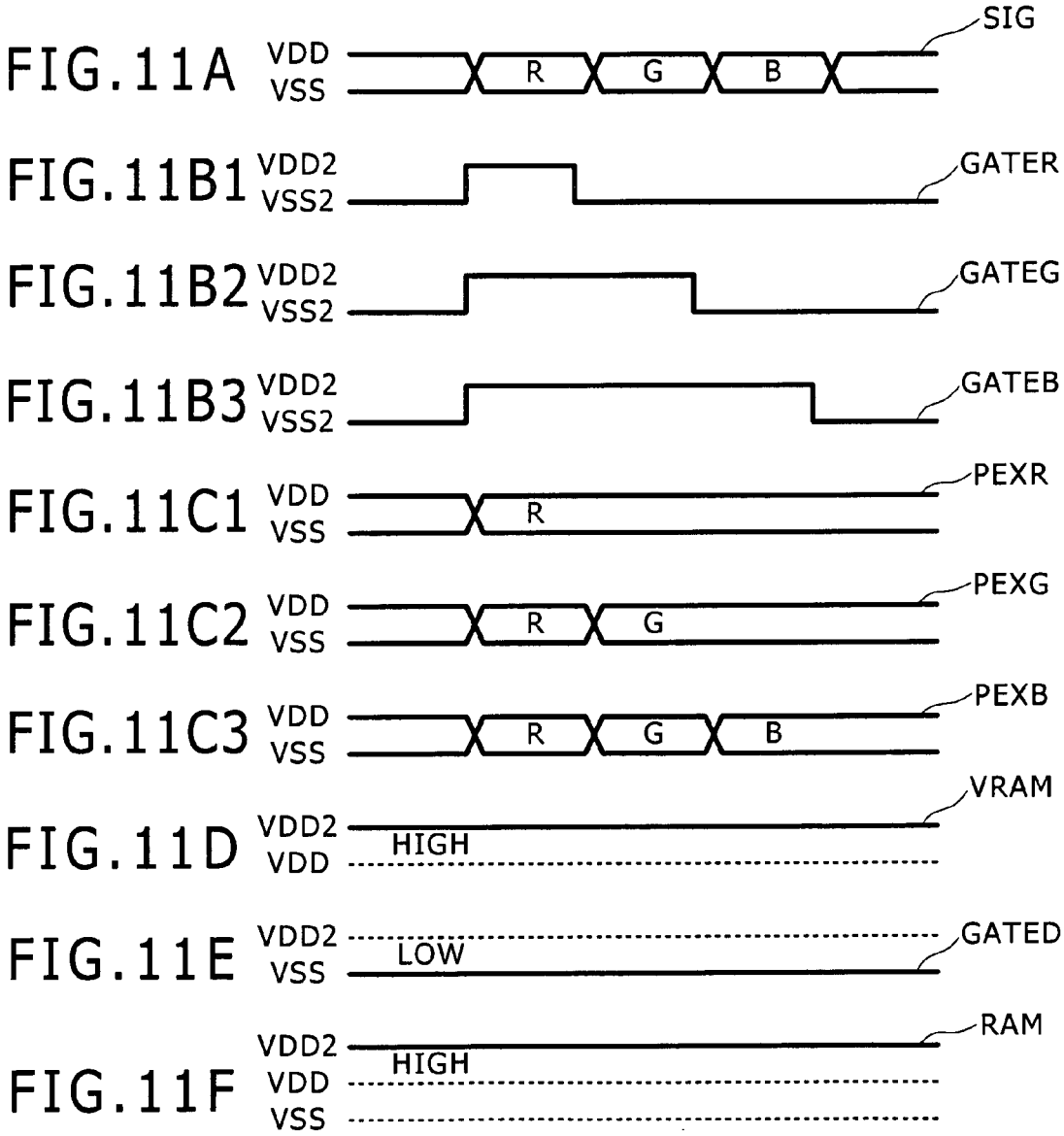
Figure 12:
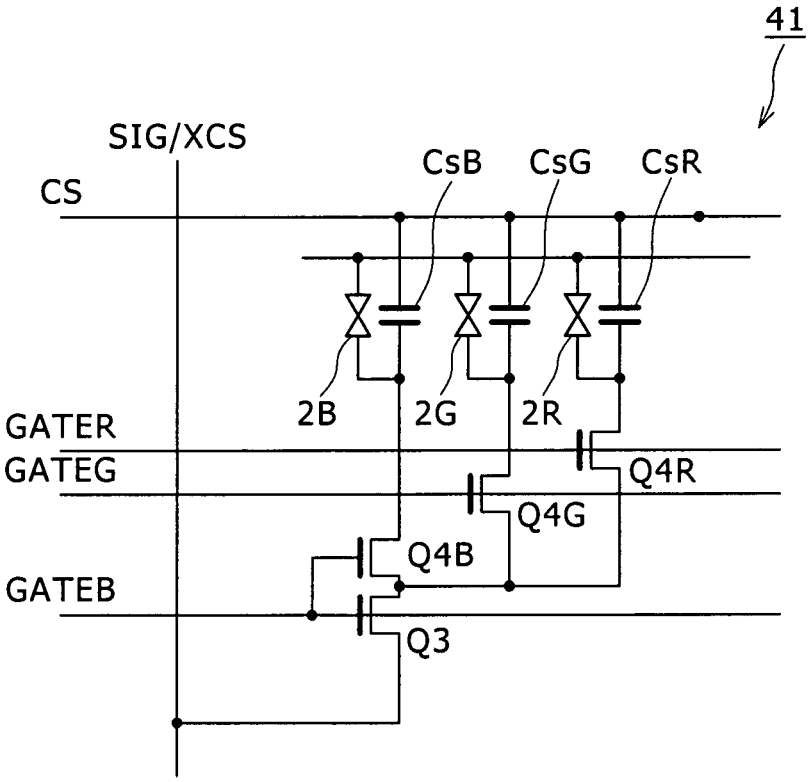
FIG. 12 shows a portion of the pixel unit employed in the image display apparatus according to the embodiment shown in FIG. 10 as the third embodiment operating in the analog driving mode.

Operations carried out in the analog driving mode are explained by referring to FIGS. 11A to 11F and 12 as follows. First of all, in the analog driving mode, an H logic level for initial setting of the transistor Q6 is stored in advance in the memory unit 3 employed in the pixel unit 41 as shown in FIG. 10 through the signal line SIG and the transistor Q11 driven by a gate signal GATED shown in FIG. 11E. Then, driving signals specifying the gradations of the red-color liquid-crystal cell 2R, the green-color liquid-crystal cell 2G and the blue-color liquid-crystal cell 2B are output to the signal line SIG on a time-division basis represented by notations R, G and B shown in FIG. 11A as follows. The red-color gate signal GATER shown in FIG. 11B1, the green-color gate signal GATEG shown in FIG. 11B2 and the blue-color gate signal GATEB shown in FIG. 11B3 are all raised to a high level at the same time in the pixel unit 41. Then, during a period denoted by notation R shown in FIG. 11A, a signal appearing on the signal line SIG is set at a level for the red color and, at the end of the period, the red-color gate signal GATER is pulled down to a low level. Thus, in the pixel unit 41, a red-color voltage PIXR appearing on a specific one of the terminals of the red-color liquid-crystal cell 2R as shown in FIG. 11C1, a green-color voltage PIXG appearing on a specific one of the terminals of the green-color liquid-crystal cell 2G as shown in FIG. 11C2 and a blue-color voltage PIXB appearing on a specific one of the terminals of the blue-color liquid-crystal cell 2B as shown in FIG. 11C3 are all set at the level of the signal appearing on the signal line SIG, that is, the level for the red color.

By the same token, during a period denoted by notation G shown in FIG. 11A, a signal appearing on the signal line SIG is set at a level for the green color and, at the end of the period, the green-color gate signal GATEG is pulled down to a low level. Thus, in the pixel unit 41, the green-color voltage PIXG shown in FIG. 11C2 and the blue-color voltage PIXB shown in FIG. 11C3 are changed to the level of the signal appearing on the signal line SIG, that is, the level for the green color. In the same way, during a period denoted by notation B shown in FIG. 11A, a signal appearing on the signal line SIG is set at a level for the blue color and, at the end of the period, the blue-color gate signal GATEB is pulled down to a low level. Thus, in the pixel unit 41, the blue-color voltage PIXB shown in FIG. 11C3 is changed to the level of the signal appearing on the signal line SIG, that is, the level for the blue color. In this way, the gradations of the red-color liquid-crystal cell 2R, the green-color liquid-crystal cell 2G and the blue-color liquid-crystal cell 2B, which are employed in the pixel unit 41, are set at their respective values sequentially on a time-division basis. It is to be noted that, in the configuration shown in FIG. 10 or 12, with the transistor Q3 kept operating in an on state, the red-color transistor Q4R, the green-color transistor Q4G and the blue-color transistor Q4B are operating by turning on and off in order to set the gradations of the red-color liquid-crystal cell 2R, the green-color liquid-crystal cell 2G and the blue-color liquid-crystal cell 2B at their respective values sequentially on a time-division basis.

Figures 13A, 13D, 13E, 13F:
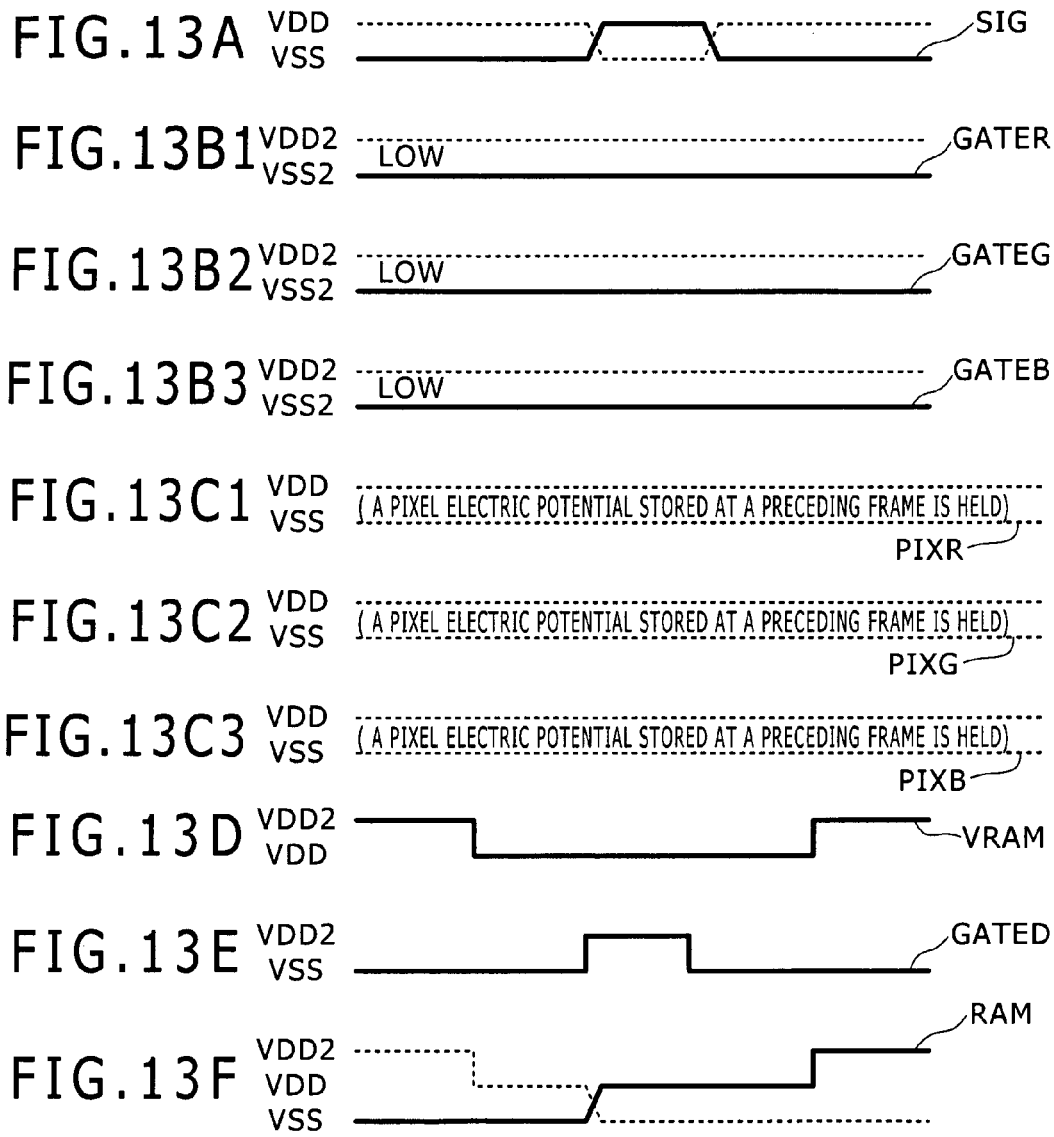
Figure 14:
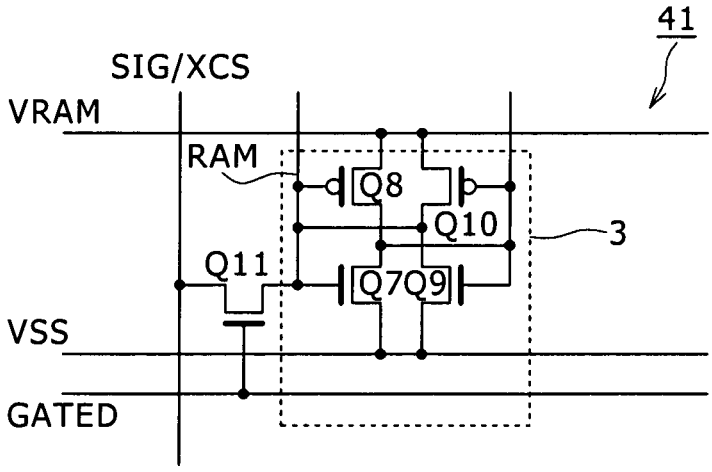
FIG. 14 shows a portion of the pixel unit employed in the image display apparatus according to the embodiment shown in FIG. 10 as the third embodiment operating in the memory mode.

By referring to FIGS. 13 and 14, on the other hand, the following description explains the memory mode set in the third embodiment as a mode in which a logic level of a signal appearing on the signal line SIG is stored in the memory unit 3. With the gate signals GATER, GATEG and GATEB each set at a low level shown in FIGS. 13B1, 13B2 and 13B3 to put each of the transistors Q4R, Q4G and Q4B respectively in the pixel unit 41 in an off state, the power-supply voltage VRAM shown in FIG. 13D as a voltage of the memory unit 3 is pulled down to a voltage VDD corresponding to the H level of a signal RAM shown in FIG. 13F as a signal appearing on the signal line SIG. It is to be noted that the transistor Q3 is also put in an on or off state along with the transistor Q4B. Then, in the pixel unit 41, the level of the signal appearing on the signal line SIG is set at the logic level of current image data DV as shown in FIG. 13A. In this state, the gate signal GATED shown in FIG. 13E is raised to a high level in order to put the transistor Q11 in an on state for electrically connecting the memory unit 3 to the signal line SIG. With the memory unit 3 electrically connected to the signal line SIG, the level of the signal RAM appearing on the signal line SIG as shown in FIG. 13F is stored in the memory unit 3. Then, later on, the gate signal GATED shown in FIG. 13E is pulled down to a low level in order to put the transistor Q11 employed in the pixel unit 41 in an off state. In this state, the power-supply voltages VRAM and RAM shown in FIGS. 13D and 13F respectively as the power-supply voltages of the memory unit 3 are raised to a voltage VDD2 corresponding to a driving voltage of the red-color liquid-crystal cell 2R, the green-color liquid-crystal cell 2G and the blue-color liquid-crystal cell 2B. Thus, the transistor Q5 or Q6 can be controlled to turn on and off.

Figures 15A, 15B, 15E, 15F, 15G:
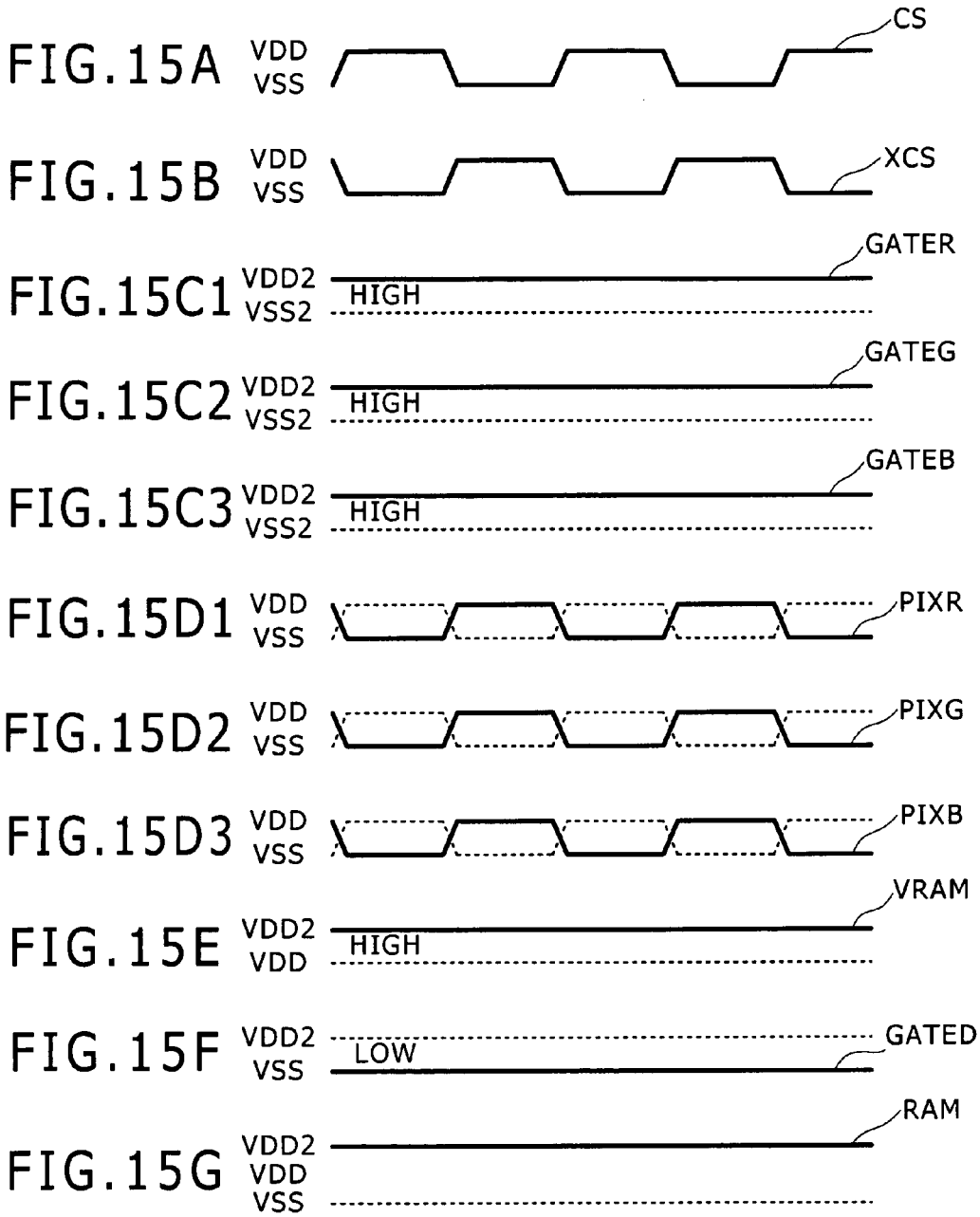
Figure 16:
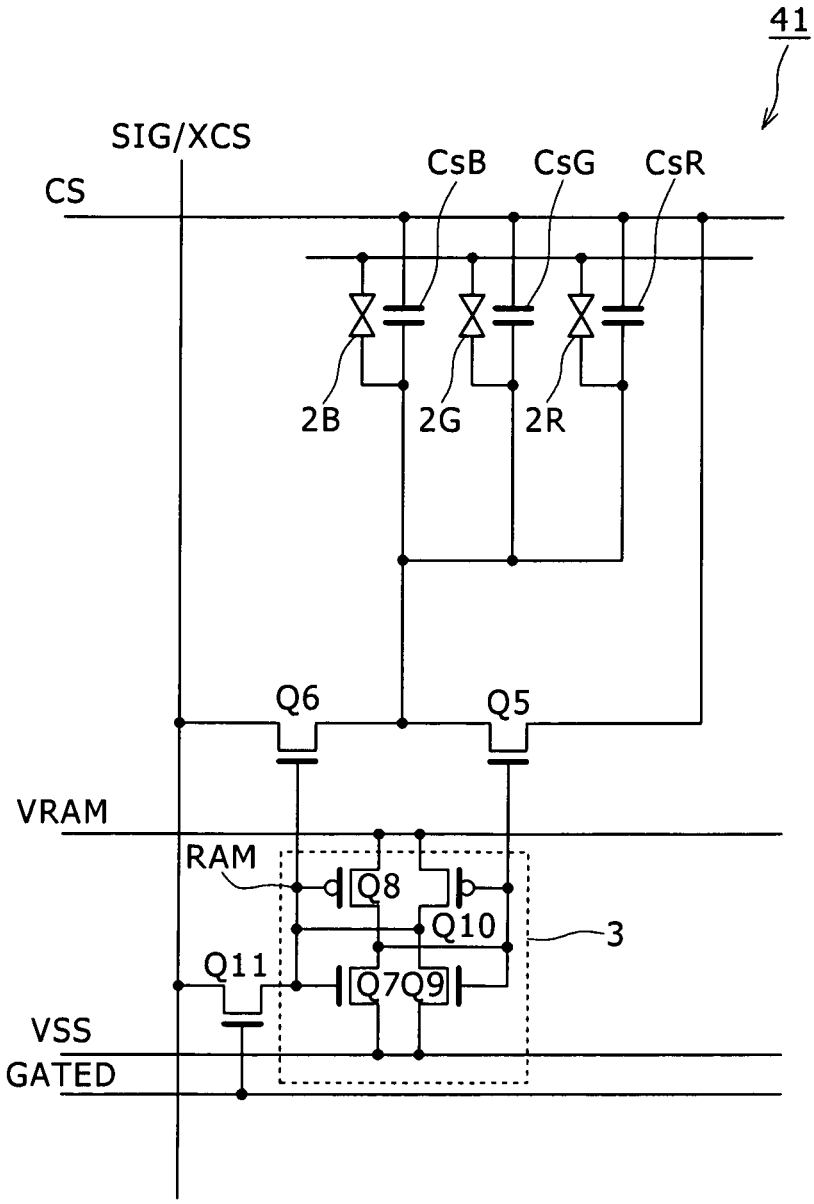
FIG. 16 shows the pixel unit employed in the image display apparatus according to the embodiment shown in FIG. 10 as the third embodiment operating in the memory mode.

FIG. 15 shows timing charts of subsequent image displaying operations carried out in the memory mode. A driving signal XCS shown in FIG. 15B as a signal having a phase opposite to the phase of the pre-charging driving signal CS shown in FIG. 15A as a signal related to pre-charge processing is supplied to the signal line SIG. Thus, in accordance with a logic level already stored in the memory unit 3 as the logic level of a signal appearing on the signal line SIG, either the transistor Q5 or Q6 is selected as a transistor to operate in the pixel unit 41 shown in FIG. 16 in order to supply respectively the pre-charging driving signal CS related to pre-charge processing or the driving signal XCS having a phase opposite to the phase of the pre-charging driving signal CS to the switch circuit employing the transistor Q3.

Later on, the blue-color gate signal GATEB shown in FIG. 15C3 turns on the transistors Q3 and Q4B. By the same token, the green-color gate signal GATEG shown in FIG. 15C2 turns on the green-color transistor Q4G whereas the red-color gate signal GATER shown in FIG. 15C1 turns on the red-color transistor Q4R. Thus, the display section displays a black and white image based on binary gradations according to logic levels already stored in the memory unit 3 as levels of the signal appearing on the signal line SIG. It is to be noted that, in this case, instead of turning on all the transistors Q3, Q4R, Q4G and Q4B, it is possible to provide a configuration in which only the blue-color gate signal GATEB is used to turn on the transistors Q3 and Q4B only. In such a configuration, the display section displays a blue image based on binary gradations according to logic levels already stored in the memory unit 3 as levels of the signal appearing on the signal line SIG. It is also possible to provide another configuration in which only the red-color gate signal GATER and the blue-color gate signal GATEB are used to turn on the transistors Q3, Q4R and Q4B only. In this other configuration, the display section displays a magenta image based on binary gradations according to logic levels already stored in the memory unit 3 as levels of the signal appearing on the signal line SIG. It is also possible to provide a further configuration in which only the green-color gate signal GATEG and the blue-color gate signal GATEB are used to turn on the transistors Q3, Q4G and Q4B only. In this further configuration, the display section displays a cyan image.

In accordance with this embodiment, a memory unit is allocated to a plurality of liquid-crystal cells as a memory common to the cells. Thus, the number of transistors can be further reduced. As a result, the opening window of the liquid-crystal cell can also be widened as well.

To put it concretely, a memory unit is allocated to a red-color, green-color and blue-color liquid-crystal cells as a memory common to the cells which compose a color pixel unit. Thus, the number of transistors in this embodiment can be reduced to 11 from 27 (=9×3) for the pixel unit 1 shown in FIG. 23. As a result, the opening window of the liquid-crystal cell can also be widened as well.

The transistor Q5 or Q6 is selected as a transistor to be electrically connected to the red-color transistor Q4R, the green-color transistor Q4G or the blue-color transistor Q4B through the transistor Q3. With such a configuration, it is possible to assure characteristics against leak currents and assure adequate reliability by using a small number of transistors as is the case of a pixel unit 51 shown in FIG. 17. In comparison with the pixel unit 41 shown in FIG. 10, in the pixel unit 51, the transistor Q3 is replaced with red-color, green-color and blue-color transistors Q3R, Q3G and Q3B paired with the red-color transistor Q4R, the green-color transistor Q4G or the blue-color transistor Q4B respectively to form switch circuits for connecting the transistor Q5 or Q6 to the red-color liquid-crystal cell 2R, the green-color liquid-crystal cell 2G and the blue-color liquid-crystal cell 2B respectively. The switch circuits are a double-gate switch circuit consisting of the red-color transistors Q3R and Q4R, a double-gate switch circuit consisting of the green-color transistors Q3G and Q4G and a double-gate switch circuit consisting of the blue-color transistors Q3B and Q4B.

Figure 17:
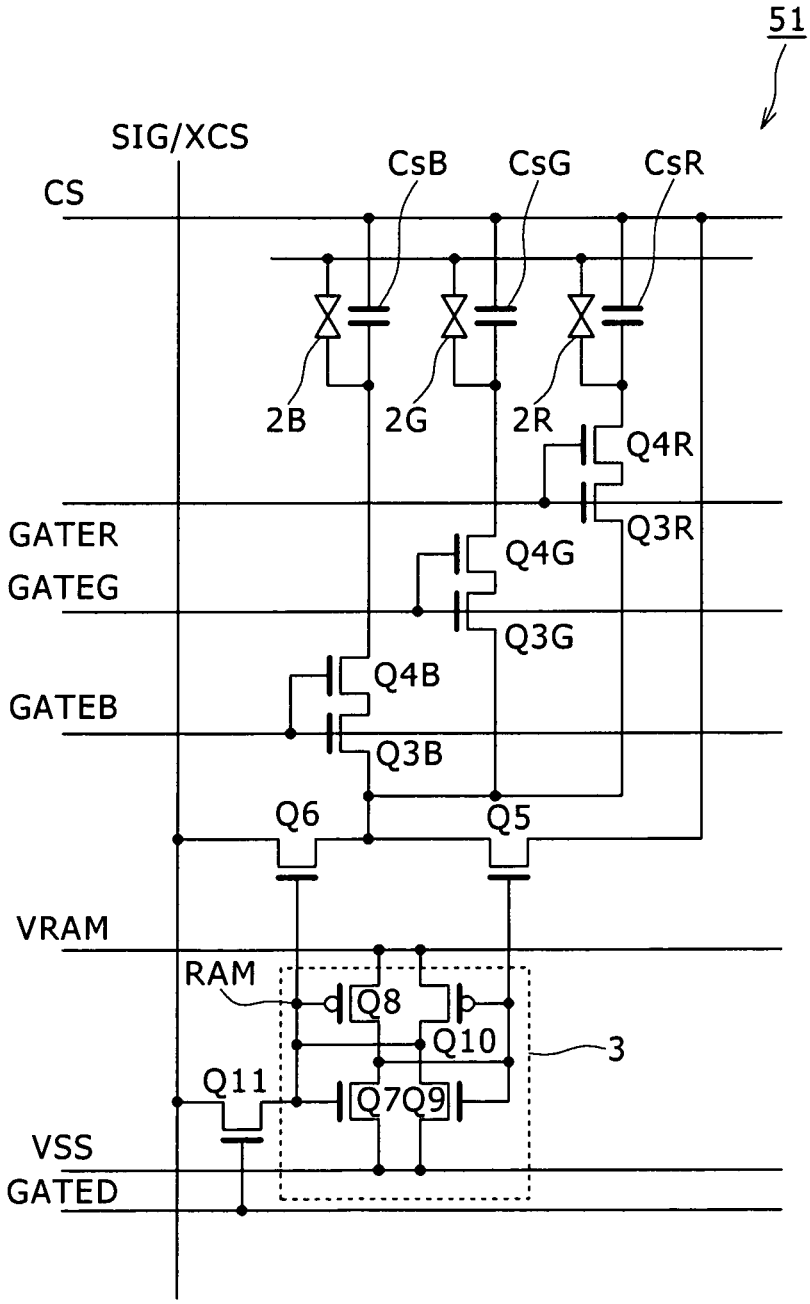
FIG. 17 is a wiring diagram showing a modified version of the image display apparatus according to the third embodiment of the present invention.

If an opening window practically wide enough can be still be assured by the pixel unit 51 shown in FIG. 17, the pixel unit 51 can be implemented since the number of transistors employed in the configuration shown in FIG. 17 is still small in comparison with that of the configuration shown in FIG. 23. As described above, in the pixel unit 51, the transistor Q3 is replaced with the red-color, green-color and blue-color transistors Q3R, Q3G and Q3B paired with the red-color transistor Q4R, the green-color transistor Q4G or the blue-color transistor Q4B respectively to form switch circuits for connecting the transistor Q5 or Q6 to the red-color liquid-crystal cell 2R, the green-color liquid-crystal cell 2G and the blue-color liquid-crystal cell 2B respectively. The switch circuits are a double-gate switch circuit consisting of the red-color transistors Q3R and Q4R, a double-gate switch circuit consisting of the green-color transistors Q3G and Q4G and a double-gate switch circuit consisting of the blue-color transistors Q3B and Q4B. In addition, in the case of the configuration shown in FIG. 17, the gate signal can also be switched among the red-color gate signal GATER, the green-color gate signal GATEG and the blue-color gate signal GATEB so that, in the memory mode, a desired display color can be selected among a variety of colors with a higher degree of freedom.

Fourth Embodiment

FIGS. 18A to 18F show timing charts of signals generated in an image display apparatus according to a fourth embodiment of the present invention. The configuration of the image display apparatus according to the fourth embodiment is identical with the configurations of the first to third embodiments except that there are some differences including the fact that the horizontal and vertical driving sections of the image display apparatus according to the fourth embodiment carry out operations in conformity with the timing charts shown in the figure. However, in order to make the explanation simple, the configuration of the fourth embodiment is described by making use of reference numerals (and notations) used for denoting the components employed in the configuration shown in FIG. 3 as the configuration of the pixel unit 31. Notation MODE used in the timing charts shown in FIG. 18 denotes the operating mode of the image display apparatus. A normal mode is the analog driving mode described before. A write mode is the memory mode in which the logic level of a signal appearing on the signal line SIG is stored in the memory unit 3, or the analog driving mode in which an initial-setting logic level is stored in the memory unit 3. A read-memory mode is the memory mode for displaying an image according to the setting of the memory unit 3. In addition, a hatched portion shown in the timing charts of FIG. 18 indicates an operation to set the signal line SIG or a driving signal such as the signal GATEA.

In the case of this embodiment, during a period T1, the horizontal and vertical driving sections operate in the normal mode. This period is a 1-frame period in which gradations of pixel units are set sequentially as shown in FIGS. 18A to 18D. In the memory mode, on the other hand, an operation to store a logic level in a memory unit 3 is carried out repeatedly during some frame periods as shown in FIGS. 18A to 18F. Thus, in the case of this embodiment, if an operation to store a logic level in the memory unit 3 has been carried out incorrectly or even if a correct logic level stored in the memory unit 3 has been inverted inadvertently due to a static-electricity phenomenon or the like, at least, after the lapse of the frame periods, an image based on correct logic levels stored in the memory units 3 can be displayed in the memory mode and it is possible to avoid image-quality deteriorations caused by inversion of bits and the like.

In the analog driving mode, the horizontal driving section periodically inverts the polarity of a driving signal appearing on the signal line SIG by carrying out processing such as field-inversion, frame-inversion and line-inversion processes. In the memory mode, on the other hand, the horizontal driving section sets the logic level of a signal appearing on the signal line SIG at a positive polarity.

Figures 18A, 18B, 18C, 18D, 18E, 18F:
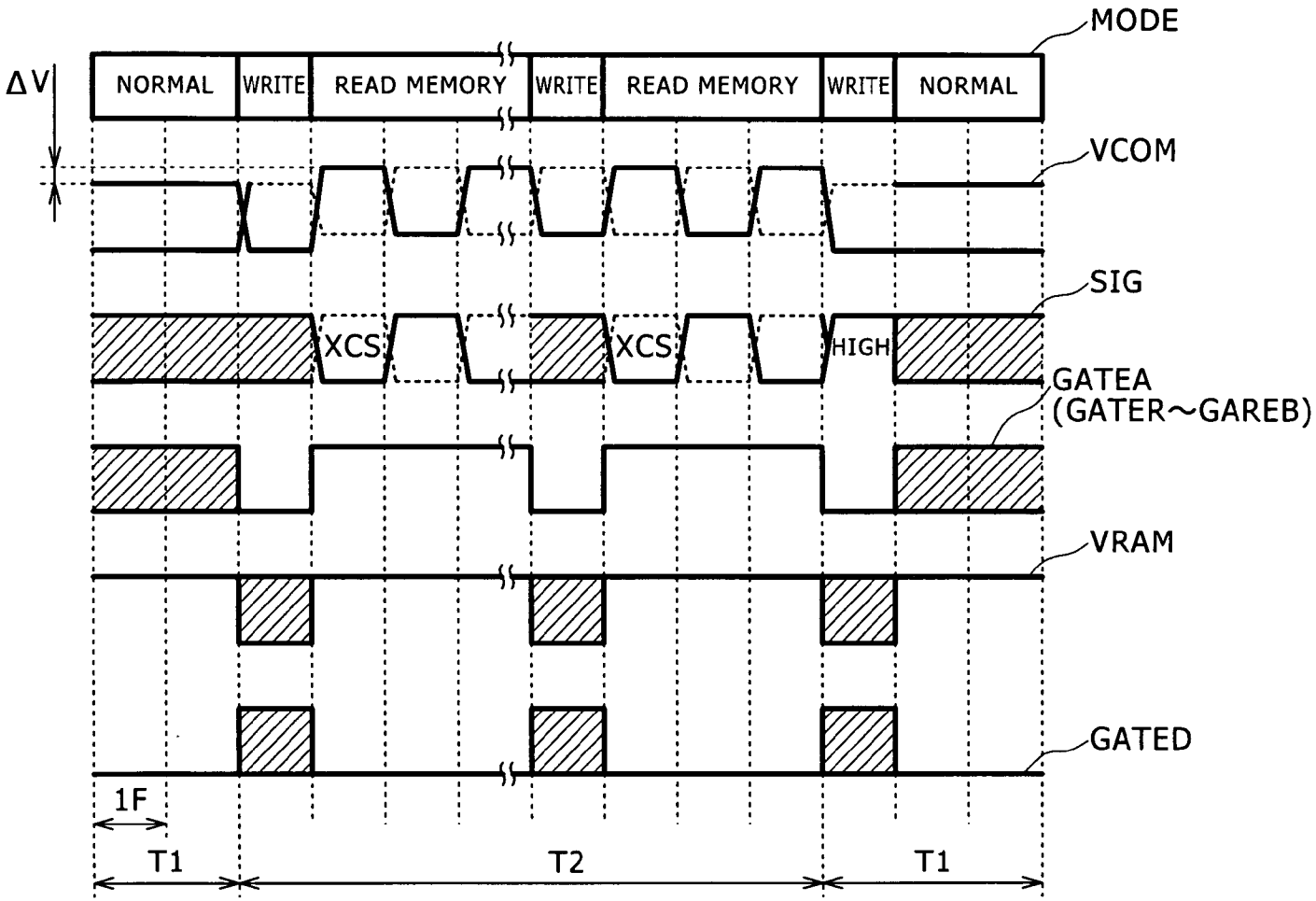
FIGS. 18A to 18F show timing charts of signals generated during operations carried out by an image display apparatus according to a fourth embodiment of the present invention.

In addition, in the case of this embodiment, in the analog driving mode, in an operation to set the logic level of a signal appearing on the signal line SIG in the liquid-crystal cell 2 through the transistor Q6 and the switch circuit employing the transistors Q3 and Q4, an offset voltage is set in the driving signal VCOM applied to the common electrode of the liquid-crystal cell 2 as shown in FIG. 18B in order to compensate for a voltage drop through the transistors Q6, Q3 and Q4. It is to be noted that notation ΔV used in the timing charts shown in FIG. 18 denotes this offset voltage. Thus, this embodiment is capable of reducing a difference between the luminance of a light beam emitted in the analog driving mode and the luminance of a light beam emitted in the memory mode.

Thus, when the operating mode is changed from the analog driving mode to the memory mode, after an operation to store a logic level in the memory unit 3 has been completed, a timing generator 16 stops the compensation making use of the offset voltage ΔV with a timing to turn on the switch circuit employing the transistors Q3 and Q4. When the driving mode is changed from the memory mode to the analog driving mode, on the other hand, at a point of time immediately preceding an operation to store a logic level in the memory unit 3, the timing generator 16 starts the compensation making use of the offset voltage ΔV.

Thus, in the case of this embodiment, in a period T2 of adopting the memory mode, an operation to apply and remove the offset voltage ΔV is carried out so that it is possible to prevent the effects of the application and removal of the offset voltage ΔV from deteriorating the quality of the image.

In addition, in the case of this embodiment, an operation to store a logic level in the memory unit 3 is carried out repeatedly in a fixed period so that, even if an incorrect logic level has been stored in a memory unit 3, it is possible to prevent the effect of the incorrect logic from deteriorating the quality of the image.

By applying the offset voltage ΔV to the driving signal VCOM appearing on the common electrode of the liquid-crystal cell 2, it is possible to compensate for a signal-level drop occurring in an operation to set the voltage appearing on the other electrode of the liquid-crystal cell 2 at the level of a signal appearing on the signal line SIG. Thus, this embodiment is capable of reducing a difference between the luminance of a light beam emitted in the analog driving mode and the luminance of a light beam emitted in the memory mode.

In addition, the above operation are carried out during a memory-mode period excluding a period to display an image in the analog driving mode. Thus, it is possible to handle a quality deterioration caused by the application and removal of the offset voltage ΔV as an aesthesia difficulty and eliminate an incompatibility sense felt by the user.

Fifth Embodiment

Figure 19:
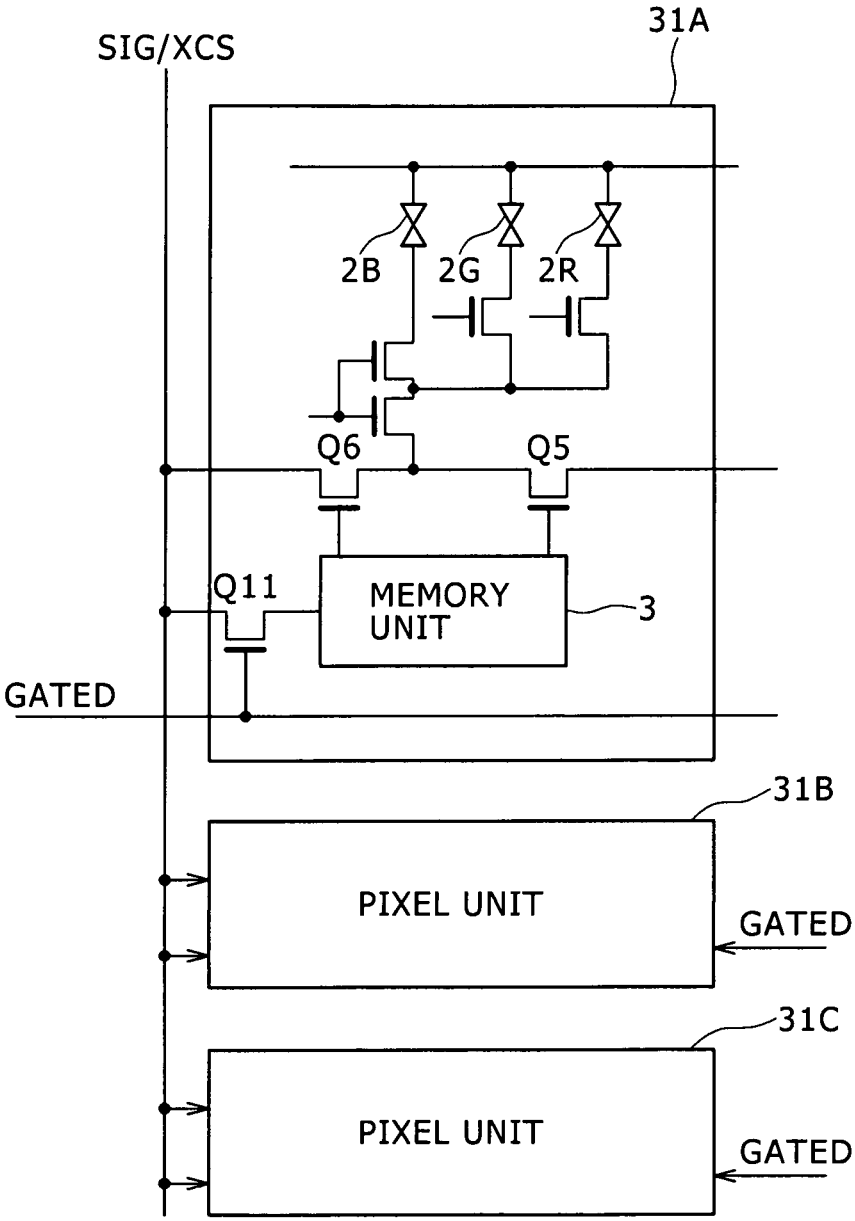
FIG. 19 is a block diagram showing the configuration of a display section employed in an image display apparatus according to a fifth embodiment of the present invention.

FIG. 19 is a diagram showing the configuration of a display section employed in an image display apparatus according to a fifth embodiment of the present invention. The configuration of this image display apparatus is identical with the configurations of the embodiments described so far except that, in the case of the fifth embodiment, an operation to store a logic level for initial setting into the memory unit 3 is carried out repeatedly in a fixed period.

Also in the analog driving mode, if a logic level for initial setting cannot be stored into the memory unit 3 correctly or even if a correct logic level for initial setting stored in the memory unit 3 has been inverted predictably in an inadvertent manner due to a static-electricity phenomenon or the like, it is difficult to correctly display the gradation of the pixel unit employing the memory unit 3. That is to say, the display of the gradation suggests a case as if the pixel unit were a defective pixel unit.

In the case of this embodiment, on the other hand, in the analog driving mode, the operation to store a logic level for initial setting into the memory unit 3 is carried out repeatedly in a fixed period. Thus, in the case of this embodiment, if a logic level for initial setting cannot be stored into the memory unit 3 correctly or even if a correct logic level stored in the memory unit 3 has been predictably inverted in an inadvertent manner due to a static-electricity phenomenon or the like, at least, after the lapse of the fixed period, an image based on correct logic levels stored in the memory units 3 can be displayed and it is thus possible to avoid quality deteriorations caused by incorrect gradation expressions.

In this embodiment, the period for newly setting the logic level for initial setting in the memory unit 3 is implemented as a vertical or horizontal blanking period of the image data SDI and the operation to newly set the logic level for initial setting in the memory unit 3 is carried out for all pixel units employed in the display section in multi-row units.

In addition, at that time, the transistor Q11 employed in the first pixel unit 31A provided at a location closest to the horizontal driving section as shown in FIG. 19 is put in an on state to operate and, after the logic level for initial setting has been stored in the memory unit 3 employed in the pixel unit 31A, the transistor Q11 employed in the pixel unit 31A is turned off and sustained in an off state as it is. In this state, the transistor Q11 employed in the subsequent pixel unit 31B shown in the same figure is put in an on state to operate in order to store the logic level for initial setting in the memory unit 3 employed in the pixel unit 31B. By the same token, after the logic level for initial setting has been stored in the memory unit 3 employed in the pixel unit 31B, the transistor Q11 employed in the pixel unit 31B is turned off and sustained in an off state as it is. In this state, the transistor Q11 employed in the subsequent pixel unit 31C is put in an on state to operate in order to store the logic level for initial setting in the memory unit 3 employed in the pixel unit 31C.

As described above, in the case of the embodiment, by taking advantage of the completion state of the operation to store a logic level for initial setting in a memory unit 3, the logic level for initial setting can be stored in another memory unit 3 so that a load borne by the horizontal driving section driving the signal line SIG can be reduced. Since the load borne by the horizontal driving section can be reduced, the configuration of the horizontal driving section can be made simpler as much as the reduction in load.

It is to be noted that, if a logic level for initial setting can be stored in another memory unit 3 by taking advantage of the completion state of the operation to store the logic level for initial setting in a memory unit 3 as described above, the operation to store a logic level for initial setting in a memory unit 3 can be carried out in multi-pixel units, that is, the operation to store a logic level for initial setting in a memory unit 3 is carried out at one time for all pixel units included in every multi-pixel unit. In this case, however, the transistors Q11 employed in a plurality of pixel units included in such a multi-pixel unit are all sustained in an on state, increasing the load borne by the horizontal driving section. Nevertheless, the time it takes to carry out the operation to store a logic level for initial setting in a memory unit 3 on all the pixel included in the entire display section becomes shorter.

As described above, in the case of this embodiment, in the analog driving mode, the operation to store a logic level for initial setting into the memory unit 3 is carried out repeatedly in a fixed period. Thus, in the analog driving mode, it is possible to prevent the quality of a displayed image from deteriorating due to inversion of bits and the like.

In addition, in this embodiment, the period for storing the logic level for initial setting in the memory unit 3 is implemented as a vertical or horizontal blanking period of the image data SDI. Thus, the operation to store the logic level for initial setting in the memory unit 3 can be carried out by effectively making use of the blanking period having no effects whatsoever on the display of an image.

Sixth Embodiment

Figure 20:
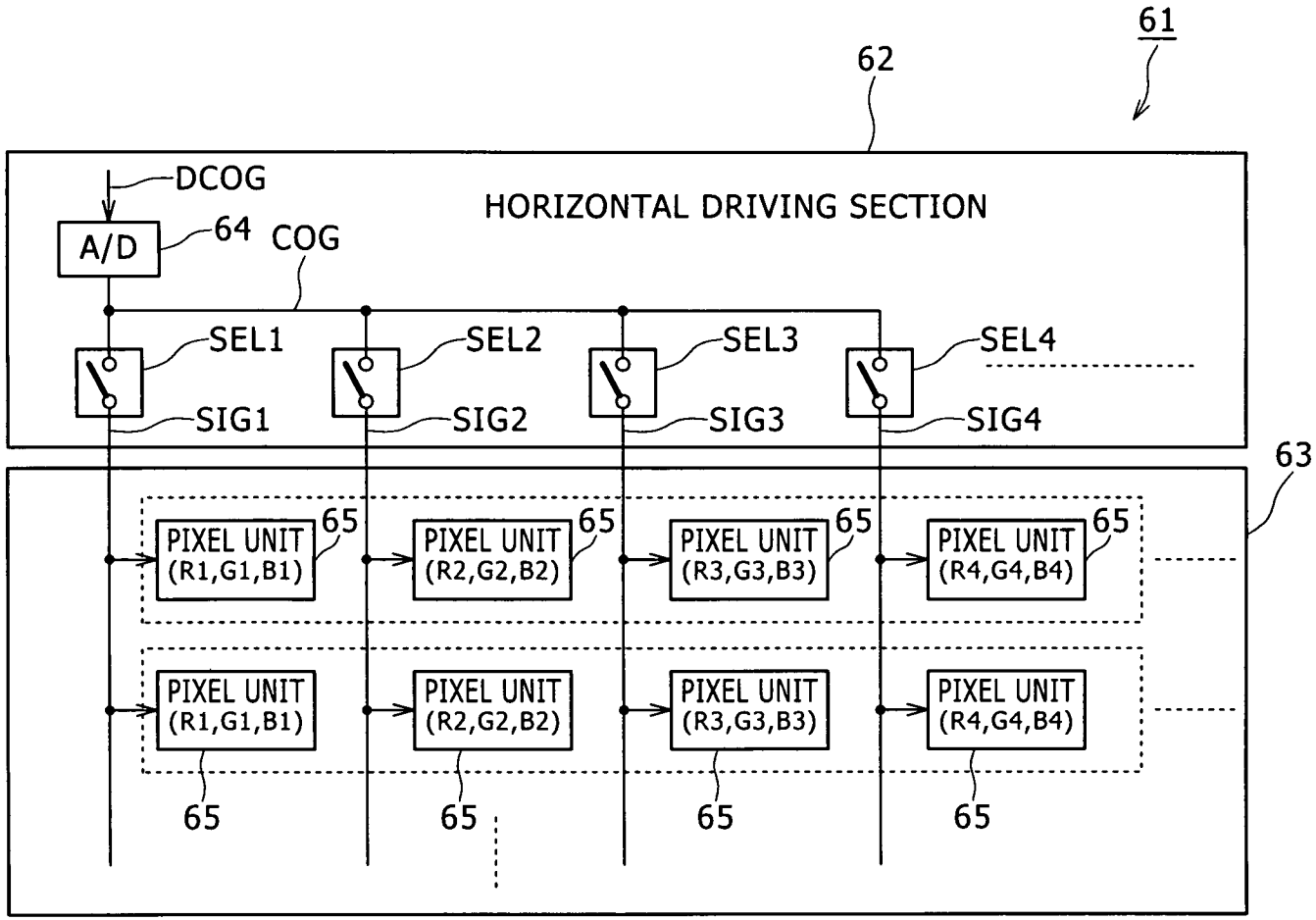
FIG. 20 is a block diagram showing the configuration of an image display apparatus according to a sixth embodiment of the present invention.
Figure 21A:
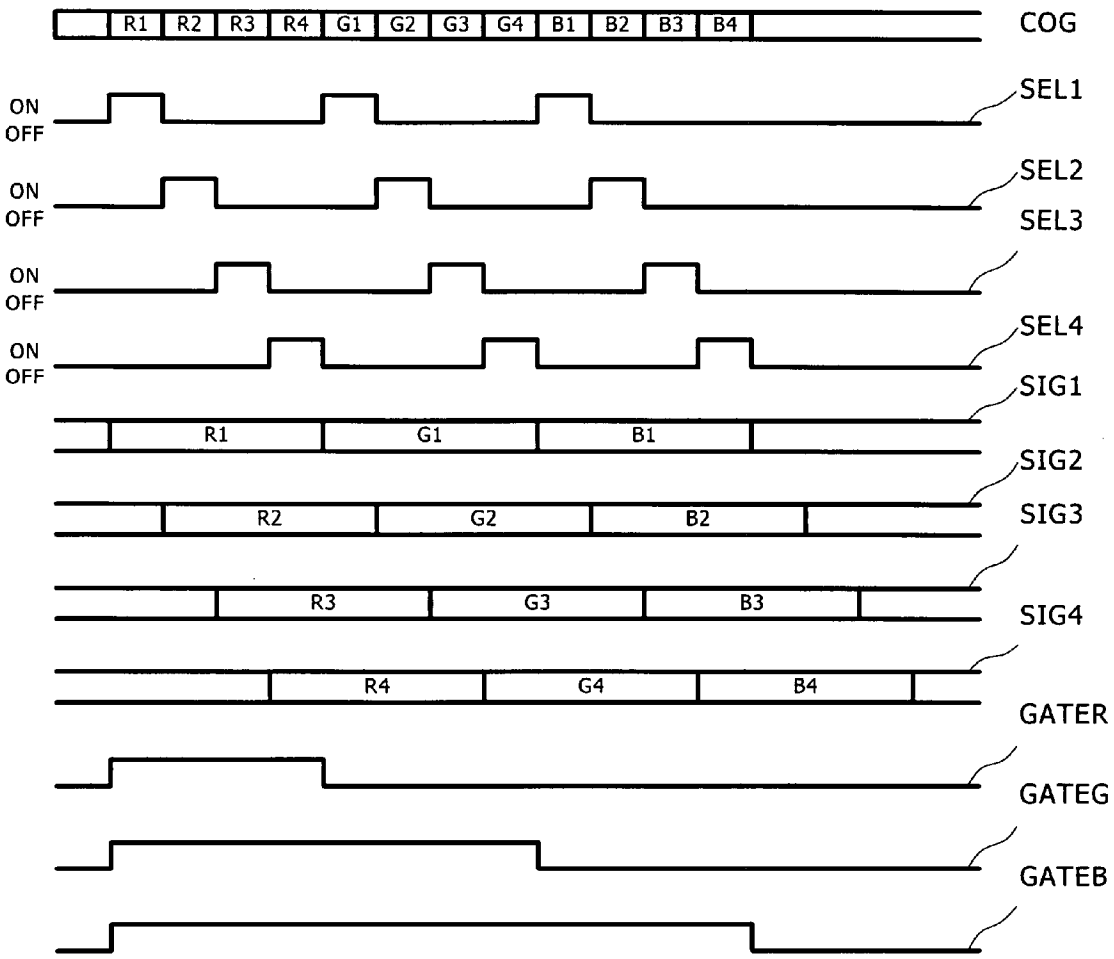

FIG. 20 is a block diagram showing a portion of an image display apparatus 61 according to a sixth embodiment of the present invention. As shown in the figure, the image display apparatus 61 employs a horizontal driving section 62 and a display section 63. The horizontal driving section 62 includes a digital/analog conversion unit 64 as well as select circuits SEL1, SEL2, SEL3 and SEL4. The horizontal driving section 62 drives a plurality of signal lines SIG1 to SIG4 on a time-division basis. In the analog driving mode, the digital/analog conversion unit 64 carries out a digital-to-analog process to convert image data DCOG for the signal lines SIG1 to SIG4 into analog driving signals COG which are distributed among the signal lines SIG1 to SIG4 on a time-division basis as shown in FIG. 21A. FIGS. 21B1 to 21B4 respectively show pulses for enabling the select circuits SEL1 to SEL4 to pass on a driving signal COG shown in FIGS. 21C1 to 21C4, respectively, as the analog driving signal COG generated by the digital/analog conversion unit 64 to the signal lines SIG1 to SIG4, respectively. As is obvious from the pulses shown in FIGS. 21B1, 21B2, 21B3 and 21B4 respectively, the select circuits SEL1, SEL2, SEL3 and SEL4 are activated sequentially.

The display section 63 employs pixel units 65 each having a configuration identical with those of the pixel units 31 according to the third to fifth embodiments described above. The driving signal COG allocated to the signal line SIG1 as driving signals R1, G1 and B1 shown in FIG. 21C1 drives the first pixel column, sequentially setting voltages on a particular one of the terminals of the liquid-crystal cell 2 employed in each pixel unit 65 on the pixel column for the red, green and blue colors respectively. By the same token, the respective driving signals COG allocated to the signal line SIG2 as driving signals R2, G2 and B2 shown in FIG. 21C2, the signal line SIG3 as driving signals R3, G3 and B3 shown in FIG. 21C3, and the signal line SIG4 as driving signals R4, G4 and B4 shown in FIG. 21C4, drives the second pixel column, the third pixel column, the fourth pixel column, respectively. The voltage of the driving signal COG appearing on each of the signal lines SIG1 to SIG4 as a signal for the red color is outputting the gradation of the liquid-crystal cell 2 while the red-color gate signal GATER shown in FIG. 21D1 is being held at a high level. By the same token, the voltage of the driving signal COG appearing as a signal for the green color and blue color are respectively outputting the gradation of the liquid-crystal cell 2 while the green-color gate signal GATEG shown in FIG. 21D2 and blue-color gate signal GATEB shown in FIG. 21D3 are being held at a high level.

Also in the memory mode, the horizontal driving section distributes pieces of image data DCOG for the signal lines SIG1 to SIG4 among the signal lines SIG1 to SIG4 respectively on a time-division basis.

In accordance with this embodiment, the same effects as the embodiments described so far can be obtained even if a plurality of signal lines are driven on a time-division basis.

Seventh Embodiment

Figure 22:
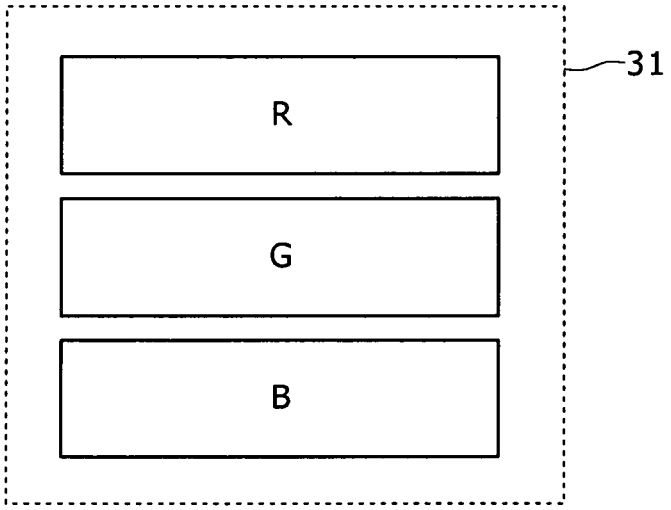
FIG. 22 is a diagram showing the planar layout of a pixel unit in an image display apparatus according to a seventh embodiment of the present invention.

FIG. 22 is a diagram showing a planar layout of a color pixel unit employed in an image display apparatus according to a seventh embodiment. The configuration of the seventh embodiment is identical with those of the third to sixth embodiments described so far except that this embodiment has a pixel layout different from that of the other embodiments. In this image display apparatus, a color pixel unit 31 shown in FIG. 22 includes a plurality of pixel units referred to as R, G and B pixel units employing red-color, green-color and blue-color liquid-crystal cells respectively. As shown in the figure, the R, G and B pixel units each have an oblong shape oriented in a direction parallel to horizontal scan lines. The R, G and B pixel units in the color pixel unit 31 are laid out consecutively in a direction parallel to signal lines SIG.

In the case of the pixel unit 31 according to any one of the third to sixth embodiments described so far, the number of scan lines associated with a signal line connected to a pixel unit 31 increases. For this reason, in the case of this embodiment, the R, G and B pixel units are each designed to have an oblong shape oriented in a direction parallel to horizontal scan lines and the R, G and B pixel units in the color pixel unit 31 are laid out consecutively in a direction parallel to signal lines SIG as described above. Thus, gaps between the R, G and B pixel units in the color pixel unit 31 are also extended in a direction parallel to horizontal scan lines. In addition, scan lines for the color pixel unit 31 are laid on the gaps in order to increase the efficiency of the layout of the scan lines.

As described above, the R, G and B pixel units are each designed to have an oblong shape oriented in a direction parallel to horizontal scan lines and the R, G and B pixel units in the color pixel unit 31 are laid out consecutively in a direction parallel to signal lines SIG. Thus, the efficiency of the layout of the scan lines can be increased. As a result, the opening window of the liquid-crystal cell can be further widened.

Eighth Embodiment

In the case the embodiments described so far, an image based on binary image data is displayed in the memory mode. It is to be noted, however, that the scope of the present invention is by no means limited to the embodiments. For example, an area gradation technique can be applied to the memory mode in order to display a multi-bit image.

In addition, in the case the embodiments described so far, an SRAM memory unit is provided in each pixel unit. It is to be noted, however, that the scope of the present invention is by no means limited to the embodiments. That is to say, a memory unit of a different type can be provided in each pixel unit. For example, a DRAM memory unit can be provided in each pixel unit.

On top of that, in the case the embodiments described so far, input image data is data having different colors such as the red, green and blue colors and a color image based on the color data is displayed. It is to be noted, however, that the scope of the present invention is by no means limited to the embodiments. For example, the present invention can also be applied to a number of applications in which a color image based on the data of more than 3 colors is displayed.

In addition, in the case the embodiments described so far, the present invention is applied to a liquid-crystal display apparatus. It is to be noted, however, that the scope of the present invention is by no means limited to the embodiments. That is to say, the present invention can be applied to a variety of display apparatus of other kinds. For example, the present invention can also be applied to an EL (Electro Luminescence) display apparatus.

In addition, it should be understood by those skilled in the art that a variety of modifications, combinations, sub-combinations and alterations may occur, depending on design requirements and other factors as far as they are within the scope of the appended claims or the equivalents thereof.

The present invention relates to an image display apparatus and an image display method. More particularly, the present invention can be applied to an image display apparatus capable of switching the operation from an analog driving mode to a memory mode and vice versa.

What is claimed is:

1. An image display apparatus comprising:

a display section having a pixel unit with a memory unit for storing a logic level of image data, and a signal line for supplying image data to said pixel unit;

wherein an operation to drive said pixel unit is switched from an analog driving mode to a memory mode and vice versa, in said analog driving mode, an analog image data signal is input to said pixel unit through said signal line and a gradation of said pixel unit is set at a value according to a level of said analog image signal, in said memory mode, a logic level of image data is input to said pixel unit through said signal line and is stored in said memory unit, said memory unit is connected to said pixel unit in order to set the gradation of said pixel unit at a value according to said logic level of said image data, a switch circuit for connecting said memory unit to said pixel unit in said memory mode is also used as a switch circuit for connecting said signal line to said pixel unit in said analog driving mode, and further wherein the switch circuit has an input that alternately receives a signal from the memory unit or an analog drive signal, each of which is transferred via the signal line, in the memory mode, a signal with a pre-charge level is initially applied to the memory unit via the signal line, and upon writing in the memory mode, a reversed-phase signal is applied to the switch circuit, while a normal-phased drive signal is applied to the drive line extending in a direction orthogonal to the signal line to connect the signal line with the pixel unit, so that the pre-charge level is written into the pixel unit.

2. The image display apparatus according to claim 1 wherein said display section includes:

a memory setting switch circuit for connecting said memory unit to said signal line;

a first switch circuit turned on and off to select a particular one of two predetermined driving signals having phases opposite to each other in accordance with a logic level stored in said memory unit;

a second switch circuit turned on and off complementarily to said first switch circuit to select the other one of said two predetermined driving signals; and a pixel unit switch circuit for connecting said pixel unit to said first and second switch circuits in order to set the gradation of said pixel unit in accordance with the setting of said memory unit;

wherein, in said memory mode, said pixel unit switch circuit connects said pixel unit to said memory unit.

3. The image display apparatus according to claim 2 wherein:

in said memory mode, said horizontal driving section properly assigns said input image data to said signal line of said display section and, after said input image data has output to said signal line, one of said two predetermined driving signals is output;

in said analog driving mode, said horizontal driving section asserts said driving signal on said signal line after asserting a logic level for initial setting of said memory unit on said signal line;

in said memory mode, said display section turns on said first switch circuit in order to select one of said particular predetermined driving signal asserted on said signal line and outputs said selected predetermined driving signal; and in said analog driving mode, said display section connects said signal line to said pixel unit through said first switch circuit and said pixel unit switch circuit after a logic level asserted on said signal line as said logic level for initial setting of said memory unit has been stored in said memory unit in order to put said first switch circuit in an on state in advance.

4. The image, display apparatus according to claim 1 wherein:

said display section includes said memory unit for a plurality of said pixel unit;

in said analog driving mode, said display section connects said pixel units to said signal line on a time-division basis in order to set gradations of said pixel units on a time-division basis; and in said memory mode, said display section connects said memory unit to all or some of said pixel units in order to set the gradation of each of all or some of said pixel units in accordance with a logic level stored in said memory unit.

5. The image display apparatus according to claim 4 wherein a plurality of said pixel units compose one pixel unit of a color image.

6. The image display apparatus according to claim 2 wherein:

said display section includes said memory unit for a plurality of said pixel units;

in said analog driving mode, said display section connects said pixel units to said signal line on a time-division basis in order to set gradations of said pixel units on a time-division basis;

in said memory mode, said display section connects said memory unit to all or some of said pixel units in order to set the gradation of each of all or some of said pixel units in accordance with a logic level stored in said memory unit;

said pixel unit switch circuit employs a first transistor and a second transistor which are wired to form a double-gate switch circuit for connecting at least one of said pixel units to said first and second switch circuits; and said pixel unit switch circuit also employs other transistors for connecting a junction between said first and second transistors to remaining pixel units not connected by said first and second transistors, said other transistors being selectively turned on and off by other gate signals.

7. The image display apparatus according to claim 1 wherein an operation to store a logic level in said memory unit is carried out repeatedly during a fixed period.

8. The image display apparatus according to claim 1 wherein:

said pixel unit is a liquid-crystal cell;

in said analog driving mode, said display section connects said pixel unit to said signal line in an operation to set the voltage of a particular terminal of said liquid-crystal cell at the level of a signal appearing on said signal line so as to set the gradation of said pixel unit in accordance with said level of said signal appearing on said signal line; and in said analog driving mode, said image display apparatus provides an offset to a voltage applied to a common electrode of said liquid-crystal cell in order to compensate for a voltage drop resulted in said operation to set the voltage of said particular terminal of said liquid-crystal cell at the level of said signal appearing on said signal line.

9. The image display apparatus according to claim 8 wherein:

in said memory mode, said image display apparatus provides no offset to said voltage applied to said common electrode of said liquid-crystal cell; and operations to provide said offset to said voltage applied to said common electrode and remove said offset from said voltage applied to said common electrode are carried out during the period of said memory mode.

10. The image display apparatus according to claim 3 wherein said image display apparatus carries out an operation to store said logic level for said initial setting in said memory unit repeatedly during a fixed period.

11. The image display apparatus according to claim 10 wherein an operation to store said logic level for said initial setting in said memory unit is carried out during a vertical or horizontal blanking period of said input image data.

12. The image display apparatus according to claim 4 wherein:

said pixel unit each have an oblong shape oriented in a direction parallel to said scan line; and said pixel unit are laid out consecutively in a direction parallel to said signal line.

13. An image display method for an image display apparatus, the image display apparatus comprising:

a display section having a pixel unit with a memory unit for storing a logic level of image data, and a signal line for supplying image data to said pixel unit;

wherein an operation to drive said pixel unit is switched from an analog driving mode to a memory mode and vice versa, in said analog driving mode, an analog image data signal is input to said pixel unit through said signal line and a gradation of said pixel unit is set at a value according to a level of said analog image signal, in said memory mode, a level of image data is input to said pixel unit through said signal line and is stored in said memory unit, said memory unit is connected to said pixel unit in order to set the gradation of said pixel unit at a value according to said level of said image data, a switch circuit for connecting said memory unit to said pixel unit in said memory mode is also used as a switch circuit for connecting said signal line to said pixel unit in said analog driving mode, and further wherein the switch circuit has an input that alternately receives a signal from the memory unit or an analog drive signal, each of which is transferred via the signal line, said image display method comprising:

switching an operation to drive said pixel unit from an analog driving mode to a memory mode and vice versa;

driving said horizontal driving section to properly assign said image data to said signal line in order to set said signal line at a logic level of said image data in said memory mode;

connecting said memory unit to said pixel unit in order to set the gradation of said pixel unit at a value according to a logic level of said input image data asserted on said signal line after storing said logic level of said input image data in said memory unit in said memory mode;

connecting said signal line to said pixel unit in order to set the gradation of said pixel unit at a value according to a level of said driving signal asserted on said signal line in said analog driving mode;

making use of a switch circuit for connecting said memory unit to said pixel unit in said memory mode also as a switch circuit for connecting said signal line to said pixel unit in said analog driving mode, and further wherein the switch circuit has an input that alternately receives a signal from the memory unit or an analog drive signal, each of which is transferred via the signal line, in the memory mode, a signal with a pre-charge level is initially applied to the memory unit via the signal line, and upon writing in the memory mode, a reversed-phase signal is applied to the switch circuit, while a normal-phased drive signal is applied to the drive line extending in a direction orthogonal to the signal line to connect the signal line with the pixel unit, so that the pre-charge level is written into the pixel unit.

14. An image display apparatus according to claim 1, further comprising:

a vertical driving section for generating a scan signal on a scan line and a horizontal driving section for generating an image data signal on a signal line of said display apparatus.

* * * * *